US005584483A

United States Patent [19]

Sines et al.

[11] Patent Number: 5,584,483

[45] Date of Patent: Dec. 17, 1996

[54] PLAYING CARD SHUFFLING MACHINES AND METHODS

[75] Inventors: Randy D. Sines, Spokane, Wash.; Steven L. Forte, Henderson, Nev.; Norman G. Kelln; Leonard A. Hale, both of Spokane, Wash.

[73] Assignee: Casinovations, Inc., Spokane, Wash.

[21] Appl. No.: 423,408

[22] Filed: Apr. 18, 1995

Related U.S. Application Data

[63] Continuation-in-part of Ser. No. 228,609, Apr. 18, 1994.

[51] Int. Cl.[6] ..... A63F 1/12

[52] U.S. Cl. ..... 273/149 R

[58] Field of Search ..... 273/149 R

[56] References Cited

U.S. PATENT DOCUMENTS

| | | | |
|---|---|---|---|
| 672,616 | 5/1952 | Handler et al. | 273/149 R |
| 1,984,702 | 12/1934 | Ruckman et al. | 273/149 R |
| 2,747,877 | 5/1956 | Howard | 273/149 R |
| 4,497,488 | 2/1985 | Plevyak et al. | 273/149 R |
| 4,515,367 | 5/1985 | Howard | 273/149 R |
| 4,586,712 | 5/1986 | Lorber et al. | 273/149 R |
| 4,659,082 | 4/1987 | Greenberg | 273/149 R |
| 4,770,421 | 9/1988 | Hoffman | 273/149 R |
| 4,832,342 | 5/1989 | Plevyak et al. | 273/149 R |

*Primary Examiner*—Benjamin H. Layno

*Attorney, Agent, or Firm*—Wells, St. John, Roberts, Gregory & Matkin, P.S.

[57] ABSTRACT

Playing card shufflers having unshuffled stack holders which hold infeed arrays of playing cards. Ejectors are mounted adjacent an unshuffled stack holder, which can be stationary or movable. Cards are ejected and discharged from the infeed array at various random positions. The ejectors can be mounted on a movable carriage. Extractors are advantageously used to assist in removing playing cards from the infeed array. Removal resistors are used to provide counteracting forces resisting displacement of cards, to thereby provide more selective ejection of cards from the infeed array. One embodiment mounts over the edge of a card table.

75 Claims, 18 Drawing Sheets

305
310
304
269
265
267
II II
II III
II II
305
310
304
266
265
267
303
281
280
292
302
292
281
284
202
303
201
281
302
233
227
255
II II
204
233
227

PLAYING CARD SHUFFLING MACHINES AND METHODS

CROSS-REFERENCE TO RELATED APPLICATION

This is a continuation-in-part of U.S. patent application Ser. No. 08/228,609 filed Apr. 18, 1994.

TECHNICAL FIELD

The invention is an automatic shuffling machine for shuffling decks of playing cards.

BACKGROUND OF THE INVENTION

Casinos, cardrooms and other gaming establishments employ many card dealers. The dealers shuffle cards, deal the cards, take bets, and otherwise play the card game. Substantial amounts of the dealers' time is spent in just shuffling the decks of cards in preparation for the ensuing card hands. During the time the dealer is shuffling, the game table is inactive and bets are not being placed. From the standpoint of the casino, it is desirable to minimize the time spent in preparing the card decks for additional play.

A number of prior art card deck shuffling machines have been invented. Most of the prior automatic shufflers have suffered from various problems. Many are relatively slow and do not help the basic problem encountered by the gaming establishment. Others are relatively complex and thus expensive to build and maintain.

Another problem area suffered by both manual and automated shuffling techniques is associated with having sequences of cards for which shuffling has not changed the sequential order. This can provide information usable to an astute gambler. Poor shuffling can also create concentrations or "slugs" which are of significance with respect to cards having a value of 10, such as in playing blackjack. A skilled card counting gambler can take advantage of such card slugs to turn the odds against the casino and in favor of the card counter. Such slugs also indicate the failure of prior art shufflers to in fact effectively rearrange the order of cards in a deck or decks being shuffled.

Thus there remains a strong need for improved shuffling machines which can effectively reorder a deck or series of decks. Additionally, there remains a need for an improved automatic card shuffler which is relatively easy to build, operate and maintain.

BRIEF DESCRIPTION OF THE DRAWINGS

Preferred embodiments of the invention are described below with reference to the accompanying drawings, which are briefly described below.

FIG. 6 is a schematic diagram showing functional blocks of the control system used in the shuffler of FIG. 1.

FIG. 15 is a top view of the elevator assembly shown in FIG. 13.

FIG. 16 is a partial sectional view taken along section line 16—16 of FIG. 9.

FIG. 19 is a perspective view of a third embodiment of shuffling machine according to this invention.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

First Embodiment Generally

Figure 1:
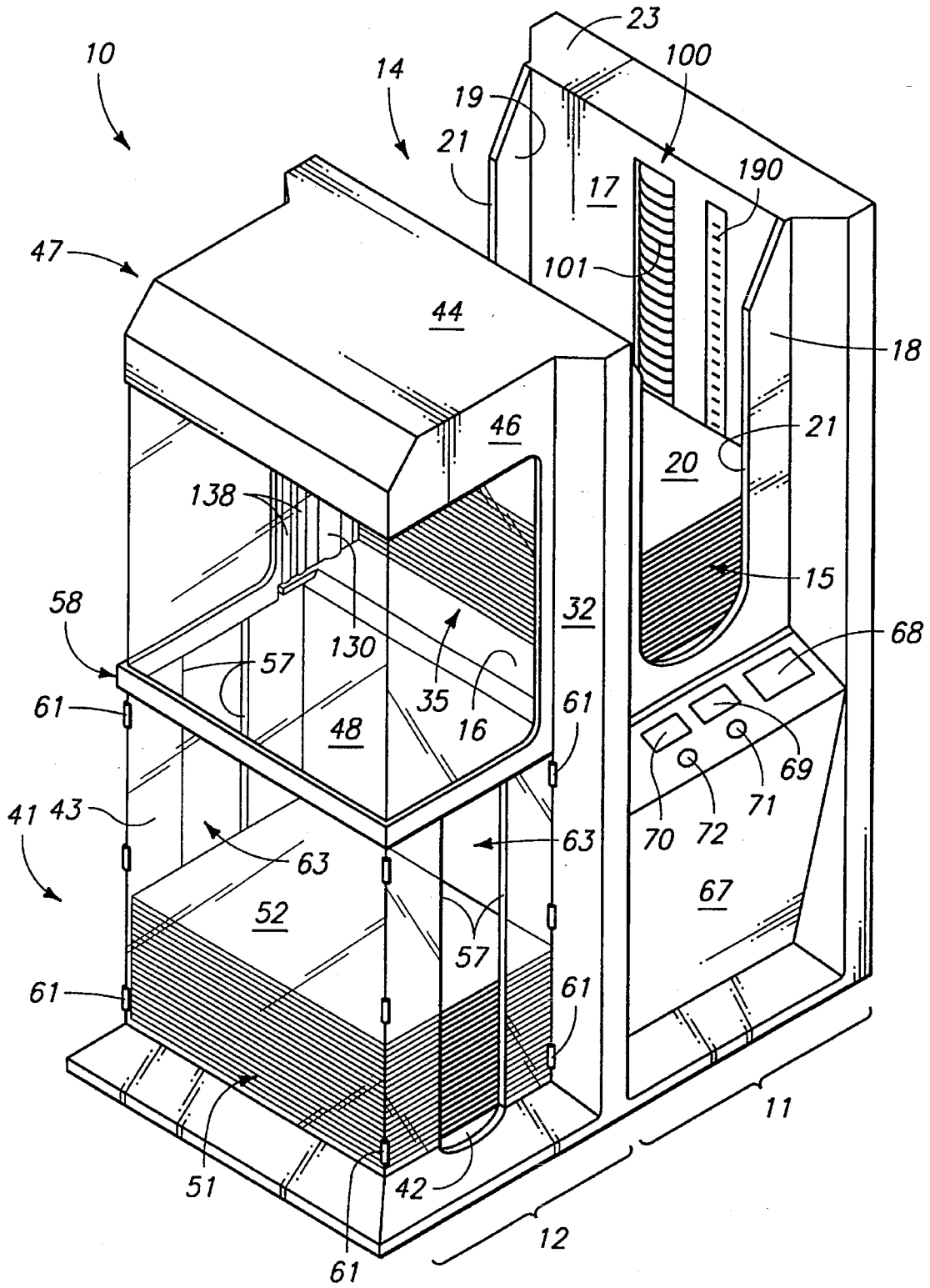
FIG. 1 is a perspective view showing a preferred shuffler according to the invention.

FIG. 1 shows a preferred playing card shuffler 10 built in accordance with the invention. Shuffler 10 includes a first section 11 and a second section 12.

Infeed or First Section

First section 11 includes a first stack holder 14 for holding a first or infeed stack 15 of playing cards. The first or unshuffled infeed stack holder 14 advantageously includes a bottom 16, ejector or end wall 17, front wall 18, and back wall 19. The front and back walls advantageously include manual access cutouts 21 which are U-shaped openings which open to the top and outside. This construction allows a dealer to more easily place cards 20 into the unshuffled stack holder 14. It also allows manual adjustment of the cards as may be needed in some situations. The openings also allow removal of unshuffled cards from the infeed holder 14 if circumstances justify removal of the stack or other infeed array of playing cards 15.

Ejector or end wall 17 extends from the bottom or floor 16 upwardly to the upper outside surface 23. The inside or intermediate boundary plane 29 is along the opposite or inward side of infeed holder 14, in opposed relationship to end wall 17. The intermediate boundary is relatively open in order to allow unshuffled cards 20 to pass from the first section 11 to the second section 12, as explained more fully below. Upper portions of the shuffler along intermediate boundary 29 include boundary wall portions 30 (FIG. 2) which connect to intermediate pillars and associated wall structures 32. The open central regions of the boundary between the first and second sections forms a card transfer aperture 35. Transfer aperture 35 is defined by bottom or floor 16, boundary wall portions 30, and the distance between rollers 130 (see FIG. 4).

The ejector end wall 17 also preferably mounts an unshuffled infeed stack array playing card detector 190. Detector 190 can be a segmented capacitive detector which senses the capacitance at various longitudinal locations along the infeed stack holder. This information is then used to make an approximate count of remaining cards for purposes of randomly or otherwise selecting a card to be discharged from the remaining cards available within the infeed holder. Outfeed or Second Section of Machine The second section 12 includes a second card holder in the form of a shuffled card receiver 41. Shuffled card receiver 41 has a bottom or second section floor 42. An outer or end wall 43 extends upwardly from bottom 42, and connects with a second section top 44. The second section 12 also preferably has a front wall 46 and a back wall 47. Receiver 41 also has an interior wall 48 adjacent to the intermediate or boundary plane 29 between the first and second sections of shuffler 10.

Shuffled card receiver 41 holds an outfeed array 51 in the form of a stack of shuffled playing cards 52. The playing cards rest face-down on floor 42 and are captively positioned between end wall 43, front and back walls 46 and 47, and interior wall 48. The lower portion or zone of the second section forms a collection receptacle forming a part receiver 41. The upper portions of the second section primarily form the upper zone of the shuffled card receiver. The upper and lower zones are approximately divided along the level of floor 16 of the first section.

The shuffled card receiver 41 preferably has continuous walls along the front, back, and outer end of the upper zone to help assure suitable stopping action for playing cards discharged from the first section through opening 35 and into the second section. These upper zone walls are advantageously made from transparent material, such as transparent glass or plastic. A medial frame band 58 extends about the three outer walls approximately along the border between the upper and lower zones of the second section.

The front and back walls of the second section are preferably formed with suitable access doors, such as the opposing dual access doors 56 and 57 shown along the front and back walls, respectively. The dual access doors are hinged, such as by spring biased hinges 61, to adjacent portions of the shuffler frame. The dual doors shown define open central sections 63 at the front and back. These central openings allow a dealer to manually grasp shuffled cards 52 and withdraw them through either the front or back sets of dual doors.

Control Panel

FIG. 1 also shows that the first section advantageously has a control panel 67. Control panel 67 can include an on-off switch 68, shuffle start switch 69, and shuffle stop switch 70. Indicator lights 71 and 72 are used to indicate that the shuffler is shuffling or in a stop or completed mode, respectively.

Card Movement

Figure 2:
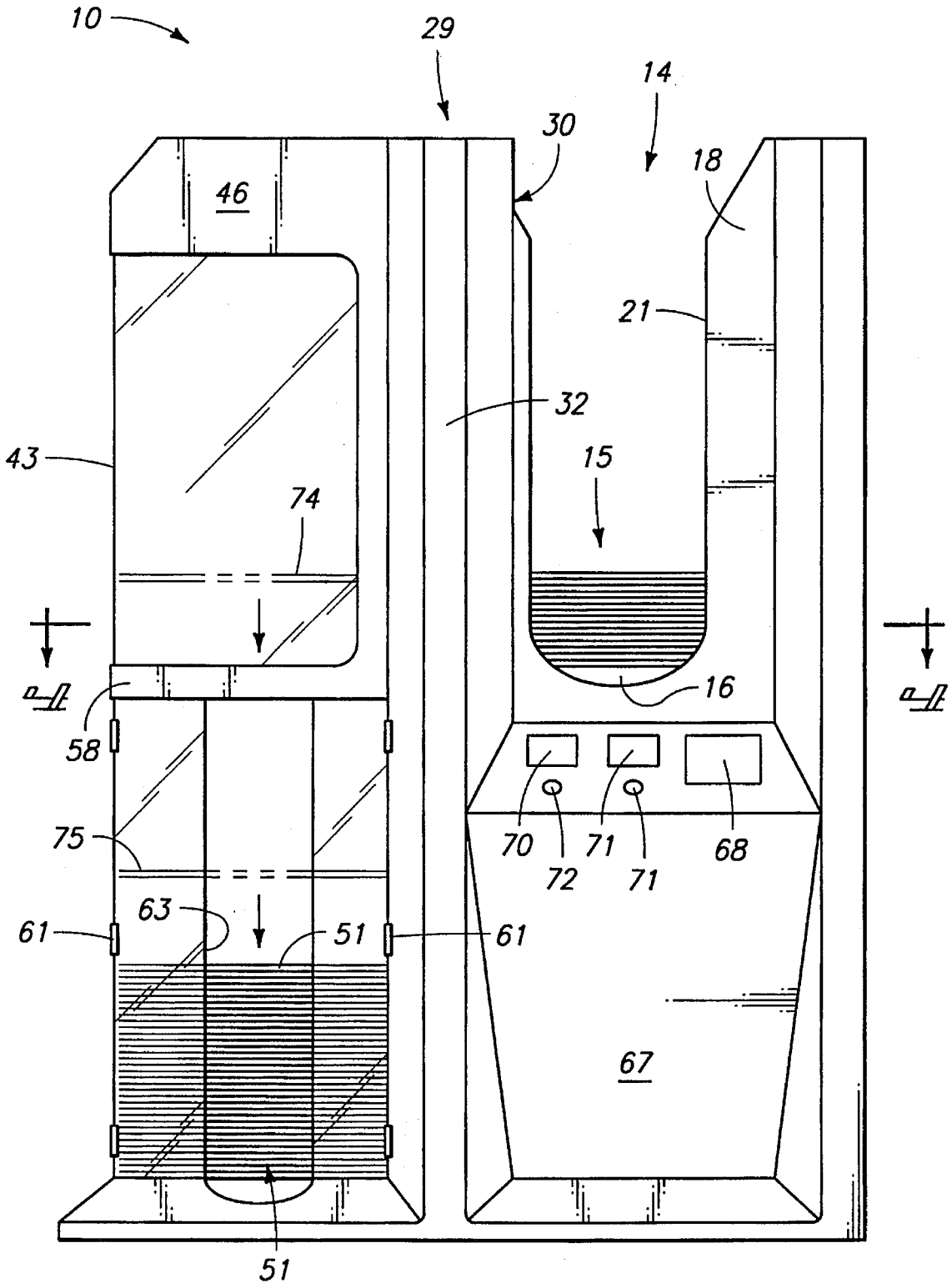
FIG. 2 is a front elevational view of the shuffler shown in FIG. 1.
Figure 3:
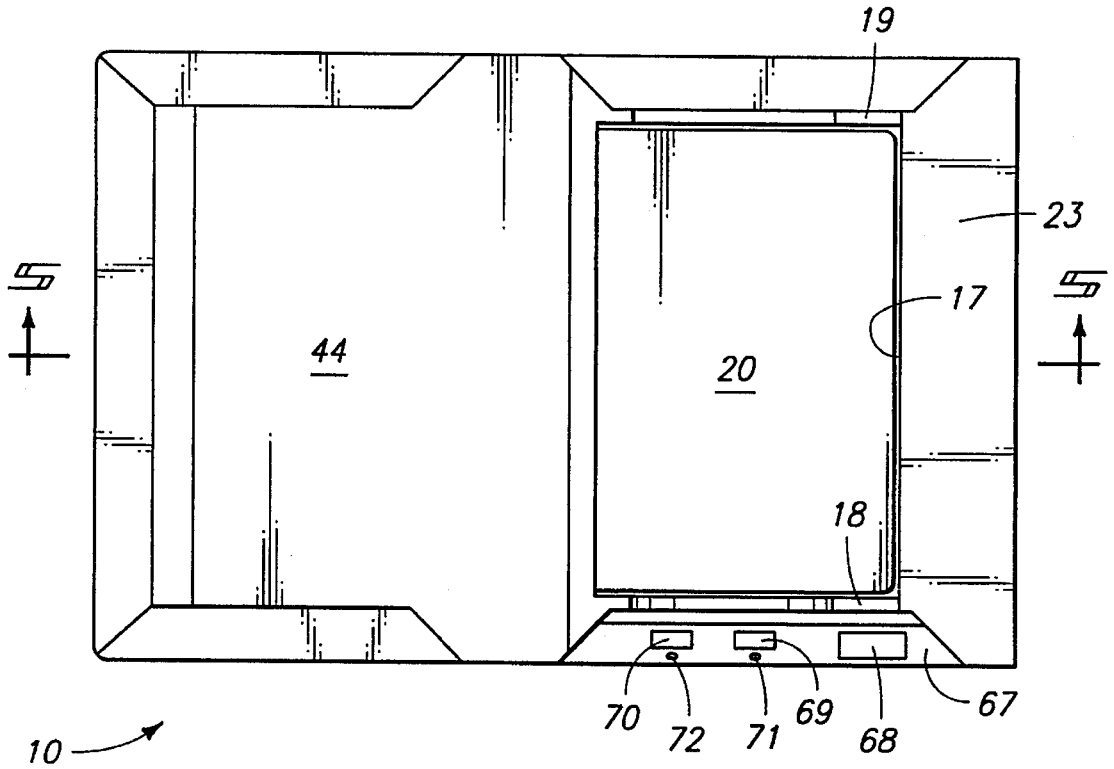
FIG. 3 is a top view of the shuffler shown in FIG. 1.

FIG. 2 shows in phantom lines, two moving cards 74 and 75. Moving cards 74 and 75 are fed from infeed stack 15 and are discharged laterally into the upper zone of the second section. Card 74 is shown in an upper drift position soon after contact with the second section end wall 43. Card 75 is shown in a second or lower drift position approaching a resting place upon the top of the outfeed stack 51.

Card Discharger

Figure 4:
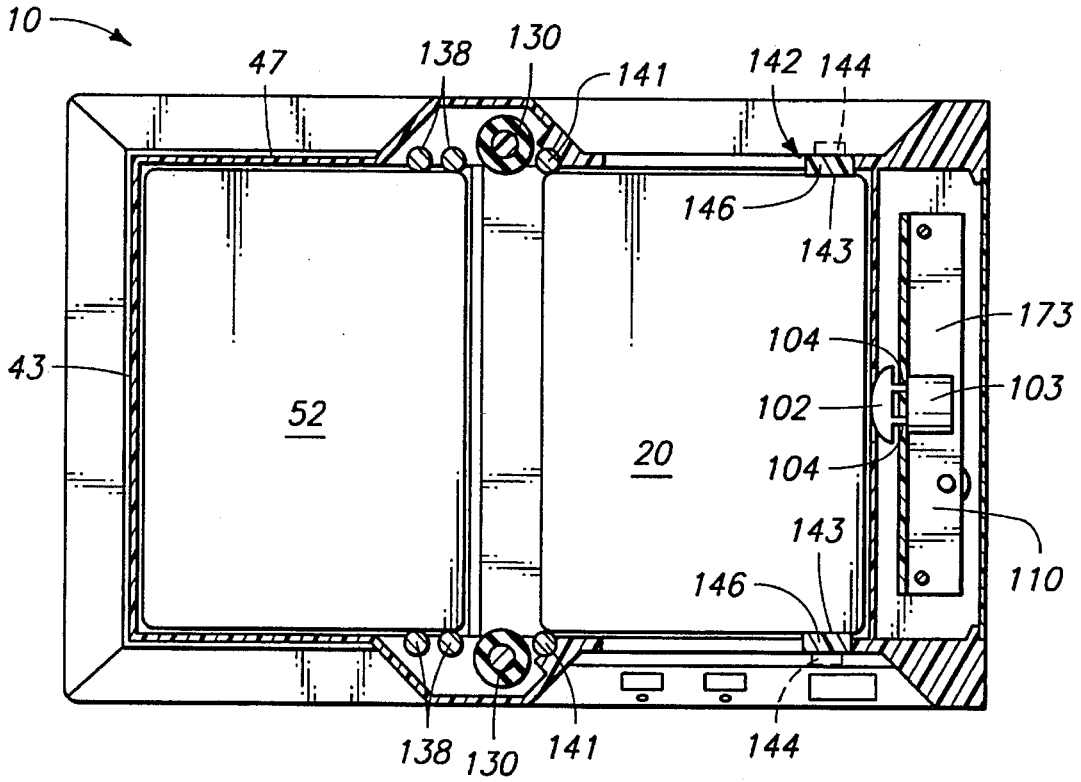
FIG. 4 is a cross-sectional view from a top viewpoint illustrating inner components of the shuffler of FIG. 1.
Figure 5:
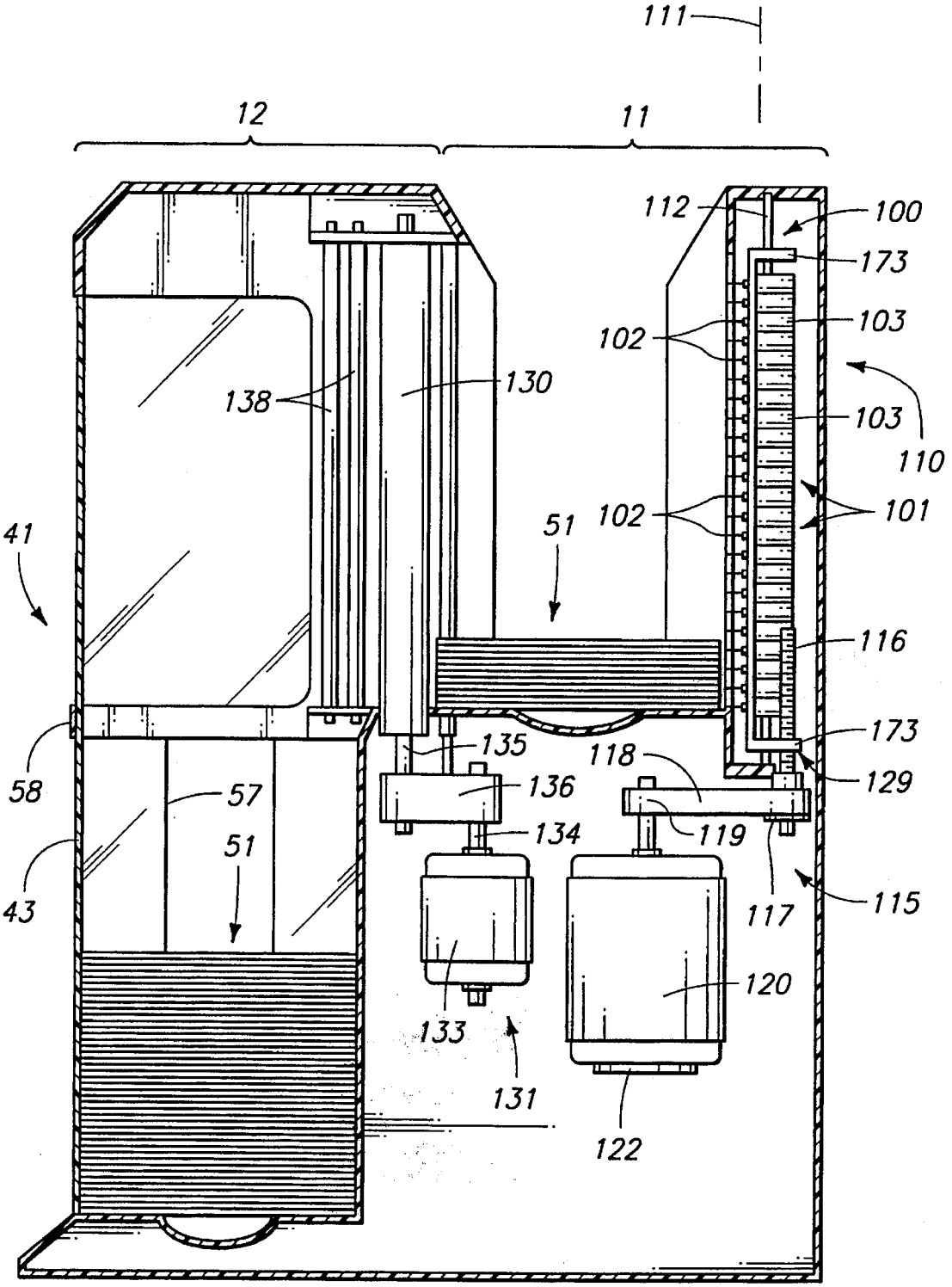
FIG. 5 is a longitudinal sectional view from a front viewpoint illustrating inner components of the shuffler of FIG. 1.

FIGS. 4 and 5 show internal components of card shuffler 10. The shuffler includes at least one discharger which is used to discharge a card 20 from the infeed stack or other infeed array 15. As shown, the discharger includes a plurality of ejectors in the form of an ejection array 100. The ejector array 100 preferably includes a plurality of individual ejector displacers 101. As shown there are twenty three (23) ejector displacers arranged in a vertical ejector displacer array which is sufficiently tall or appropriately spaced to allow ejection of cards from an infeed stack array containing six (6) standard playing card decks. Each deck has fifty two (52) cards, thus providing a maximum infeed array containing three hundred twelve (312) playing cards. This provides ejector displacers at an average card spacing of approximately one ejector per twelve (12) cards.

The ejector displacers have ejector displacement heads 102. The ejector displacement heads 102 preferably have an arched or semicircular outer edge or contact face (see FIG. 4). The displacer heads 102 are each connected to an ejector displacer actuator 103. Actuators 103 are mechanically connected to the head using connection bars 104. Actuators 103 are preferably small electrical solenoids which can be activated and deactivated. The solenoids are preferably controlled so that activation causes the ejector displacer heads to extend outwardly into an extended position. In the extended position the head engages and displaces a playing card contained within stack 15. This displacement begins the ejection process. Actuators 103 are also preferably controlled so that deactivation causes the ejector displacer heads to retract. In the retracted position the heads are spaced from the normal position of the infeed card array 15.

FIG. 5 shows that the ejector displacers are preferably mounted upon an ejection carriage 110. Ejection carriage 110 is mounted for controlled movement relative to the infeed stack of cards. More specifically, the ejection carriage is mounted for movement along a carriage axis 111. Carriage axis 111 is defined by two guide rods 112 mounted to the frame of the shuffler. The carriage guide rods are preferably placed at space positions, one toward the front of the shuffler and one toward the back. A carriage frame 173 is constructed and mounted to the guide rods for slidable movement thereon in a direction parallel to the carriage axis 111.

Ejector displacer carriage 110 is provided with a carriage position driver 115 which is used to provide controlled movement of the ejector carriage along the guide rods. Carriage driver 115 includes a carriage drive screw 116 which is threadably received by a screw drive carriage connector secured to carriage frame 173, such as threaded aperture 129. Drive screw 116 is connected for rotation by a drive screw pulley 117. A screw drive belt 118 is trained around pulley 117 and Ca complementary screw drive primary pulley 119. Screw drive primary pulley 119 is connected to the output shaft of an electrical motor 120 which is the screw drive prime mover.

The screw drive motor 120 is preferably a stepper motor or servo-controlled motor capable of accurate positional control. The drive motor also is preferably provided with an angular encoder 122 which has portion connected to the opposite end of the output shaft. The screw drive encoder 122 generates an accurate digital signal indicative of the angular position of the motor. This encoder information is used with a carriage position counter system 123 (FIG. 6) which after being calibrated indicates the linear position of ejector carriage 110. Data from the resulting carriage position indicator 124 is provided to a central controller 150. Controller 150 is connected to the screw drive motor 120 to provide a control signal which determines the positional change of the motor needed to provide the desired ejector carriage position used in the next ejection step of the shuffler.

The card discharge system of shuffler 10 also preferably includes one or more extractors. As shown, shuffler 10 includes a pair of edge engaging roll extractors 130. Extractor rolls 130 are driven in counterrotationary relationship by a extractor drive 131. Extractor drive 131 includes an extractor drive motor 133 which has a rotational output shaft 134. Output shaft 134 is connected to a counterrotation transmission 136. Transmission 136 is preferably a gear assembly which has two outputs which receive the drive shafts 135 of extractor rolls 130 therein. This construction allows the extractor rolls 130 to be reliably driven at the same angular velocities but in opposite angular directions. The extractor rolls are spaced and positioned so that the rolls engage playing cards displaced by ejector array 101. As shown, the extractor rolls engage the displaced cards along the end edges of the cards. The counterrotationary motion of the extractor rolls pulls the displaced card from the infeed stack to thus complete the card discharge or removal process.

The extraction subsystem is preferably aided by one or more discharge guides. As shown, shuffler 10 is provided with two ancillary guide rollers 138 along both sides. Guide rollers 138 are preferably passive rollers without any drivers but are mounted for free rotation.

Card Discharge Resistors

FIG. 4 shows that shuffler 10 is also preferably provided with two types of card removal resistors or counters 141 and 142 which resist or counteract removal of cards from the infeed stack. The removal resistors can be static or dynamic. If static then the resistors can simply be elongated resilient pads with faces angled to engage the corners of the discharging cards. Static pad resistors (not shown) can be made from a foam or other suitable material.

As shown, the shuffler includes dynamic removal resistors 141. Dynamic resistors 141 are preferably rotating cylindrical members covered with flailing fibers, such as synthetic nylon bristle fibers. The resistors 141 are mounted adjacent to the forward corners of the infeed stack. Resistors 141 are actively driven in counterrotating directions opposing discharge of cards. The rotational motion is advantageously provided by additional output receptacles formed in gear unit 136. The dynamic resistors serve to help prevent unintended ejection of unselected cards from stack 15. The greatest risk of unintended ejection is associated with the cards adjacent to the card being ejected. This risk of unintended ejection is caused by surface friction between the adjacent card and the card being engaged and displaced by the activated ejector displacer head 102. Some risk also exists that the ejection head 104 may strike two cards.

The removal or ejection resistance subsystem also preferably includes controllable active card removal resistors 142. Removal resistors 142 are mounted along the front and back of the infeed stack holder 14. The active removal resistors 142 include longitudinal strips 146 which preferably have padded contact faces 143 mounted thereon. Padded contact faces 143 engage the edges of the playing cards of the infeed stack. Piezoelectric or other suitable contact drivers 144 are mounted between the frame of the shuffler and the longitudinal strips 146. The active resistor drivers serve to controllably move the active resistors inwardly and outwardly. When moved inwardly into contracted positions, the co-acting contractionary resistors function to squeeze or grasp the infeed stack. When moved outwardly into expanded positions, the active resistors function to release the cards contained in the infeed stack. The active removal resistors are controlled to engage and grasp the infeed stack during the ejection process in order to reduce the risk of removing multiple cards rather than the single card which is intended to be ejected. Resistors 142 also serve to jostle and straighten the cards of the infeed stack.

Control System—First Embodiment

FIG. 6 shows a diagrammatic or schematic view of a preferred control system used in shuffler 10. The control system includes a central controller 150 which can be selected from a variety of suitable electronic controllers. Central controller is electrically connected to receive signals from power switch 68, start switch 69, and stop switch 70 on control panel 67. Controller 150 provides signals to run indicator 71, and stop indicator 72 mounted on the control panel 67.

Controller 150 is connected to screw drive motor 120 to provide control signals thereto which indicate action which should be taken by the screw drive to move the ejector carriage 110. Encoder 122 sends signals to carriage position counter 123, which in turn signals central controller 150 concerning the position of the ejector carriage. Encoder 122 and counter 123 provide a carriage position indicator 124.

Controller 150 is also connected to operate extraction roller drive motor 135. Additionally, controller 150 is connected to the piezoelectric drives 144 for the active resistors 142, to provide intermittent operation thereof as described above. Still further, controller 150 is connected to read the approximate number of cards in the infeed array using the infeed card detector 190.

Operation and Methods—First Embodiment

The invention further includes novel methods for performing automated shuffling of playing cards. The methods include forming an unshuffled array of playing cards which are to be shuffled. The forming of the unshuffled array is advantageously done by forming a stack of playing cards. The forming of the unshuffled array is done in such a manner so as to provide playing cards which are in face-to-back relationships throughout the unshuffled array. Face-to-back relationship refers to the standard condition in which playing cards are sold wherein the face of one card is adjacent to the back of the next adjacent card.

The novel methods further include holding the unshuffled array in an unshuffled array holder. This is advantageously accomplished by holding the infeed stack 15 in the infeed stack holder 14. Holding can further be enhanced by grasping the infeed stack array using the active resistors 142. Such grasping is accomplished by contracting opposing complementary resistors against edges of the playing cards.

The methods further include selectively discharging playing cards from the unshuffled infeed array. The playing cards are discharged from various discharge positions within the array. The discharge positions are most preferably selected in a random fashion from the available array positions left in the stack at the time of discharging.

The selective discharging of playing cards from various positions within the unshuffled card array, also includes selecting a playing card to be discharged. The selecting process is believed capable of being performed under a number of numerical selection processes. It is believed most preferable to perform the card selecting step in a random manner. This random selection is most ideally performed by the central processor 150, appropriately programmed to also perform a random number generation process. The random number generating process is preferably performed in such a manner that the random number is generated with respect to the number of playing cards remaining in the infeed stack. This is determined by the infeed stack array playing card detector 190.

The discharging process is also preferably performed by including an ejecting and displacing of playing cards by extending an ejection head against an edge of the playing card and forcing the card being ejected and displaced. The ejection head performs an inserting action between the playing cards which are adjacent to the card being ejected. The forcing performs a displacing action upon the selected card aligned with the ejection head which was extended.

As shown, the discharging process further preferably includes extracting playing cards from the infeed array. The extracting step is preferably an adjunct to an initial partial ejection or displacement using an activated ejection head 102. Extracting is advantageously accomplished by engaging edges of the selected displaced card using a movable extractor. The step is more preferably accomplished by rolling the edges of the selected card using an extraction roller or rollers. Extraction rolling is most preferably accomplished by rolling the card edges using opposed counterrotating extraction rollers which are rotating at the same angular velocity.

The methods of the invention can further be conducted so as to include guiding the card being discharged. The guiding action can be performed by the passive guide rollers 138 and driver extraction rollers 130.

The novel methods further include receiving discharged playing cards in a shuffled card receiver. This is preferably accomplished by discharging the cards against a stop or rebound surface to perform a stopping and aligning functions. This causes the discharged cards to effectively stop at a desired horizontal position. The discharged playing cards also preferably function by dropping within a shuffled card receiver to form shuffled card stack array 51.

The methods of this invention can further include removing shuffled playing cards from the shuffled card array by removing such cards from the receiver 41. In shuffler 10, this is done by manually grasping a group of cards contained in the outfeed stack and withdrawing them through the opening defined by swinging doors 56 and 57.

Second Embodiment Generally

Figure 7:
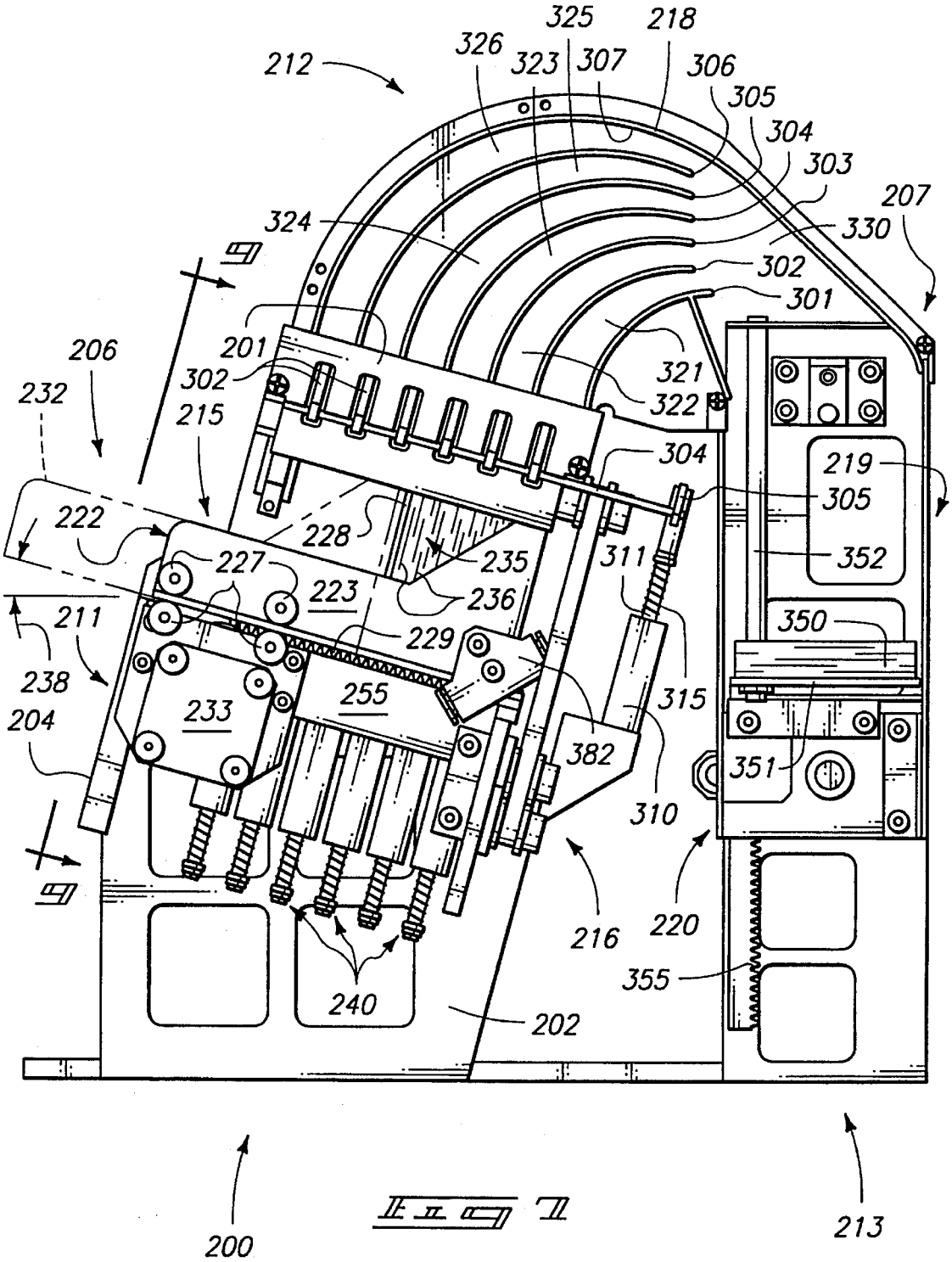
FIG. 7 is a side elevational view of a second shuffler made in accordance with this invention. Portions have been removed for purposes of illustration.
Figure 8:
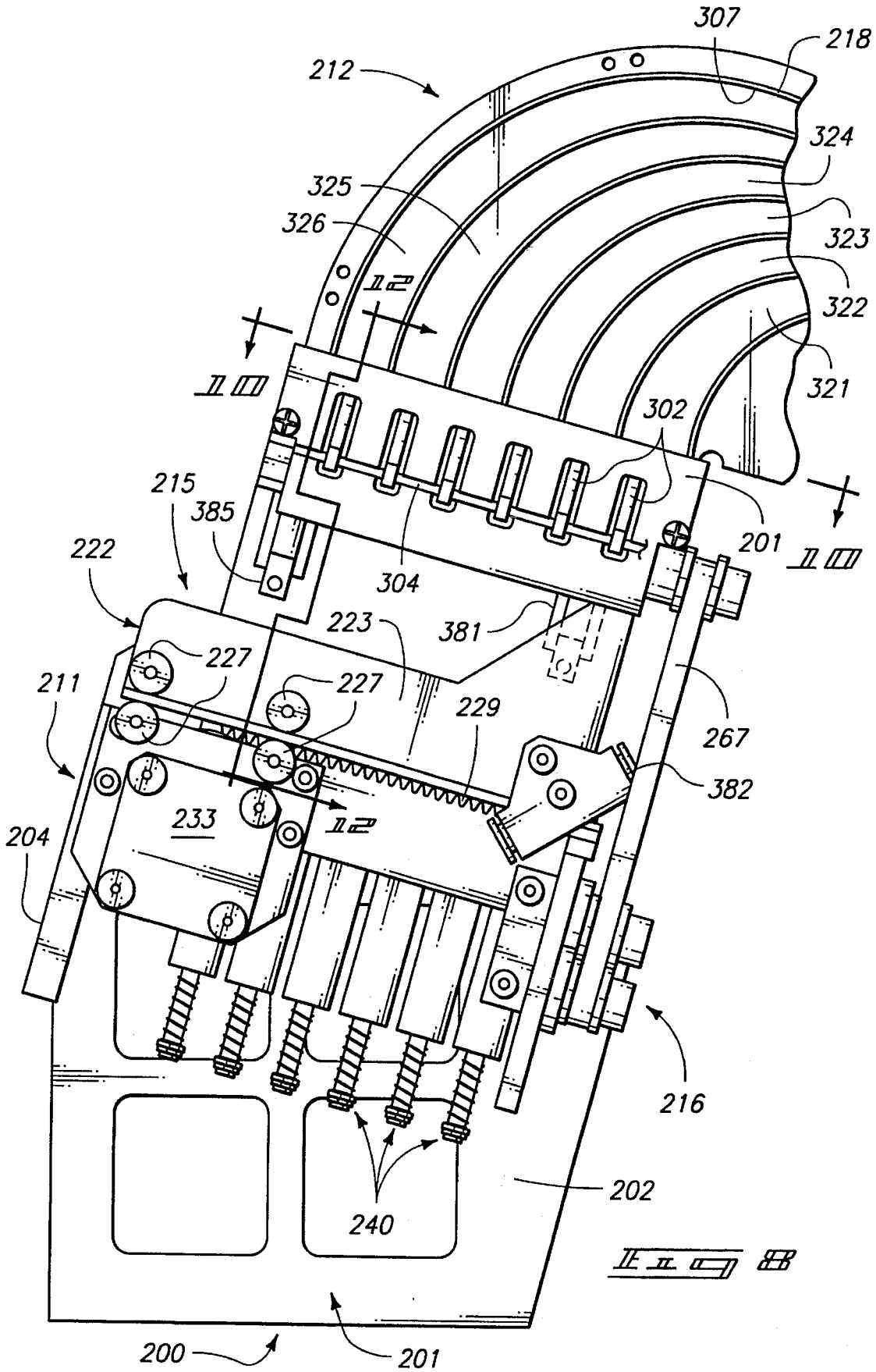
FIG. 8 is an enlarged partial side elevational view of the shuffler of FIG. 7.

FIG. 7 shows a second shuffler 200 made in accordance with this invention. Shuffler 200 includes a frame or framework 201 which will be detailed further hereinafter. Shuffler 200 has three primary subdivisions. The first major subdivision 211 includes a card infeed 215, card discharger 216, card straightening or aligning apparatus 300, and other related components.

The second major subdivision 212 principally includes a card trajectory guide 218. Guide 218 guides cards discharged from the first subdivision 211 into a third subdivision 213.

The third major subdivision 213 includes a shuffled card receiver 219 and associated receiver elevator 220. Cards move from the trajectory guide 218 and fall into the receiver 219 under the forces of gravity and momentum imparted to the cards during discharge from the first subdivision. The receiver elevator adjusts downwardly and more cards are deposited into the receiver.

The following description considers various subassemblies and components making of the shuffler 200 in greater detail. Operational descriptions are also included at appropriate points and in an operation subtitled below.

First Subdivision Frame

First subdivision 211 has an associated first subdivision framework forming a part of the general framework 201. The first subdivision framework includes a first side frame panel 202 and a second frame side panel 203. A rear framework panel 204 extends between side panels 202 and 203, and is fastened thereto using suitable frame fasteners 208. The frontal portion of the first subdivision also is provided with a front frame panel (not shown) which extends between side framework panels 202 and 203. The upper portions of side panels 202 and 203 have a series of traverse support beams 209. Transverse support beams 209 are fastened to side panels 202 and 203, and also serve additional functions as explained in greater detail below.

Infeed Card Holder

Figure 9:
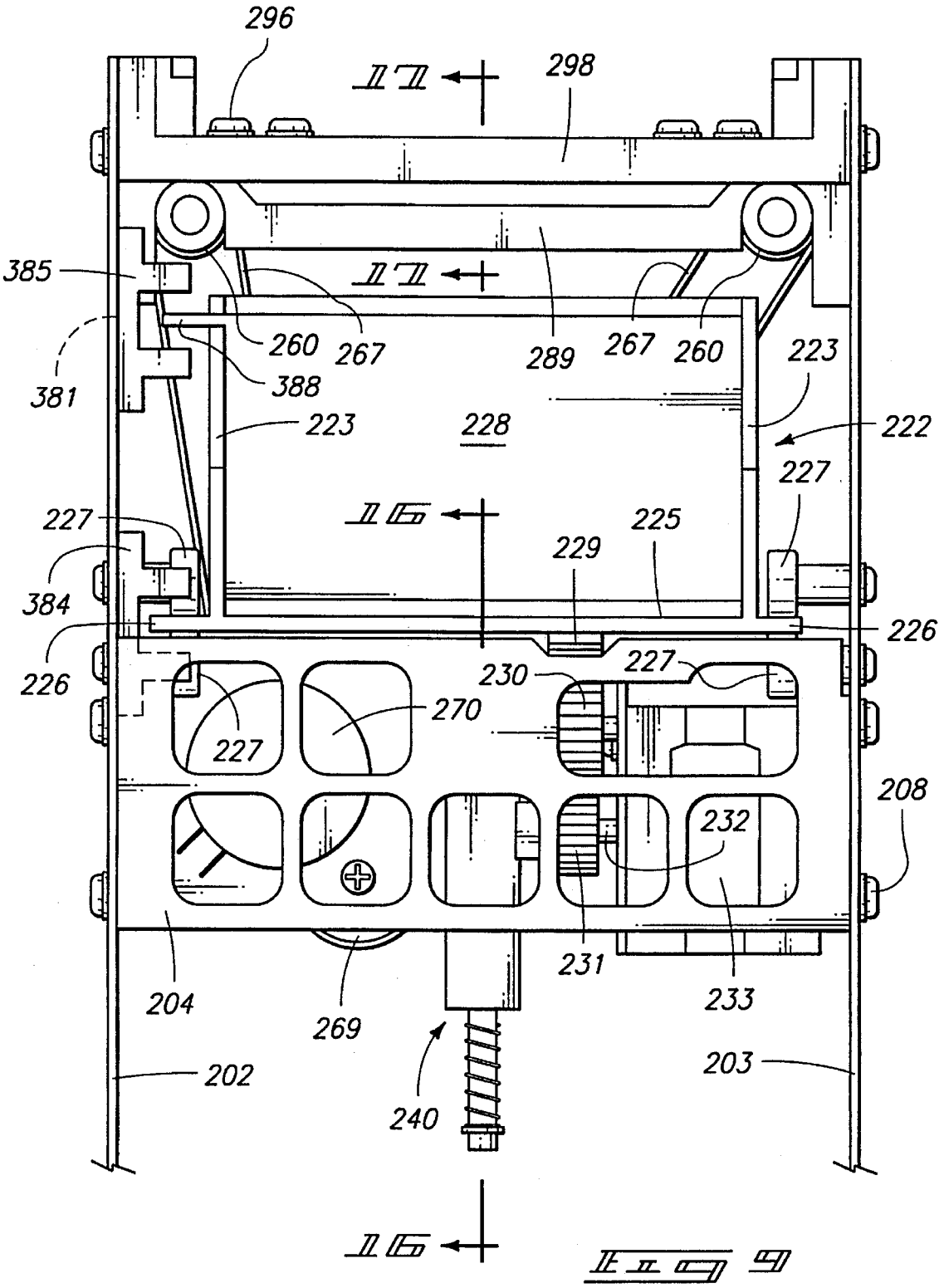
FIG. 9 is an enlarged partial rear view of the shuffler of FIG. 7 taken along a line of sight which is aligned with an inclined input cassette at about 15° from horizontal, as indicated by view line 9—9 in FIG. 7.

The card infeed 215 preferably includes an infeed stack cassette 222. FIG. 9 shows infeed stack cassette 222 in greater detail. Cassette 222 includes opposing cassette side panels 223 and cassette front panel 224. Cassette 222 also includes a bottom panel 225. Additionally, each lower outside edge of cassette 222 preferably includes support flange 226 which advantageously extends outwardly and is supported between cassette guide rollers 227. Cassette guide rollers 227 are preferably arranged in pairs above and below support flange 226 at two pair locations per side of the cassette.

Infeed cassette 222 is open along the top and rear end. This facilitates installation of the infeed stack array of cards 235. Stack array 235 contains individual cards 236 which are in stack formation arranged so that adjacent cards of the array are in contact in face-to-back relationship. Cassette 222 holds the stack array 235 substantially on edge at an inclined angle discussed below in greater detail. Cards 236 are ejected from the infeed cassette upwardly, and discharged from the infeed array as will also be explained in greater detail below.

The infeed card array is held on the rearward side by a movable infeed stack array follower 228, shown best in FIG. 9. As shown, follower 228 is an L-shaped piece which simply rests within the cassette 222. The upstanding portion of the L-shaped follower is adjacent to the most rearward card in the infeed stack 235. The other leg of the L-shaped follower slides along the bottom panel 235. During operation the cassette and follower are jostled to move the follower and keep the card stack array 235 in the upstanding arrangement. The follower also advantageously is provided with a sensor extension arm 388. Sensor arm 388 extends outwardly as shown in FIG. 9 to be detected by the optical beam detectors 381 and 385, which are described below.

Discharge Position Movement Drive

Cassette 222 also includes a cassette drive gear rack 229 which preferably extends along most or all of the length of cassette 222. Rack 229 is engaged by cassette drive pinion gear 230. Cassette drive pinion gear 230 meshes with a cassette drive motor output gear 231. Gear 231 is mounted upon an output shaft 232 forming a part of infeed cassette drive motor 233. The infeed cassette drive moves cassette 222 between a forward position shown in FIG. 7 towards the right, and a rearward position 232, shown in phantom. The cassette drive forms a discharge position drive which moves the cassette and supported cards into various intermediate positions as well as the extreme forward and rearward cassette positions. These positions are used to discharge randomly selected individual cards from various discharge positions assumed during the discharge operation.

It is preferable that the infeed stack array and cassette be oriented and driven at an inclined angle. FIG. 7 shows an infeed stack inclination angle 238. Infeed stack inclination angle 238 is preferably in the range of 5°to 20° of arc, more preferably 12° to 18° of arc, even more preferably 15°, measured relative to horizontal. This inclination angle creates a gravitational bias which helps to maintain infeed stack 235 forwardly against front panel 224 and within the cassette 222. This inclination angle also provides a reduced face-to-back contact or normal force between adjacent cards as compared to when the cards are stacked in a vertical array as is used in the first embodiment described above. This reduced normal force between the adjacent cards makes it easier to eject cards from the infeed array. It also provides a gravitational bias, tending to keep cards downward and together, unless the particular card is being discharged.

Card Discharger

Figure 11:
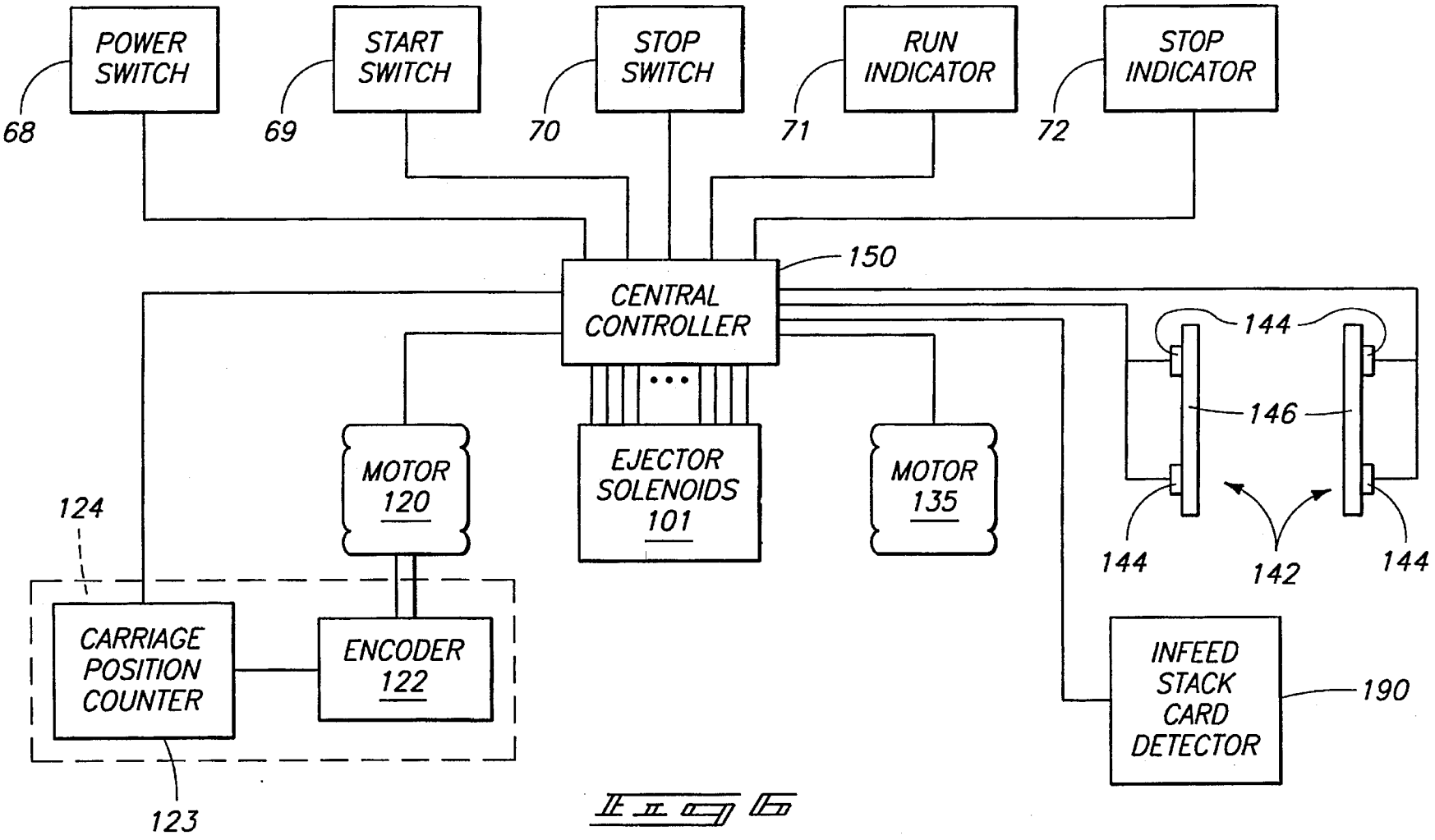
FIG. 11 is an enlarged frontal view of selected components of the shuffler of FIG. 7 shown in isolation to illustrate basic operational relationship of key components.

The first subdivision 211 also includes several mechanisms which are involved in ejecting and more generally discharging cards from the infeed stack 235. The card discharger 216 preferably includes an ejector array containing multiple card ejectors 240. As shown, there is an array of six individual ejectors. FIGS. 11 and 16 shown card ejectors 240 in greater detail. Ejector solenoids 241 have a ejector solenoid shaft 242. Ejector solenoid shaft 242 is preferably provided with a yoke or forked shaft head 243. A slot 244 formed in the forked head 243 receives an ejector head piece 245. Head pieces 245 are supported on the shaft using mounting pins 246. The ejector heads 245 are preferably formed in a T-shape as indicated in FIG. 11. Head pieces 245 are relatively thin, about the thickness of the playing cards being ejected, as shown in FIG. 16.

Ejectors 240 also preferably include deceleration springs 247, which are positioned between the solenoid casings 248 and enlarged heads 249 formed at the lower end of shaft 242. No attempt has been made in FIG. 16 to illustrate the electrical coils or windings contained within casings 248, but it should be understood that the solenoids are constructed in a typical fashion.

FIG. 16 further shows a solenoid mounting bar 250 which is secured to the framework 201. Mounting bar 250 has a series of solenoid mounting receptacles 255 in which the individual solenoids are partially received and mounted. The solenoid mounting bar 250 also provide support for a series of ejector head guides 251 which are secured to the mounting bars using a suitable means, such as using fasteners 252.

FIG. 11 is a schematic drawing showing important components associated with discharge of playing cards 236 from the infeed array 235. As FIG. 11 illustrates, ejectors 240 displace the cards upwardly part way. Additional travel is needed to clear the ejecting card from the infeed array stack. FIG. 11 shows two discharge rollers 260 which turn in counter-rotationary directions. The playing cards are displaced a sufficient amount by ejectors 240 so that the edges of cards 236 reach a tangent point 261 associated with each discharge roller 260. Drive rollers 260 engage the card edges at tangent points 261, thereby applying upward force upon both opposing lateral edges of the card in order to expel or discharge the card upwardly and from the infeed stack.

Figure 10:
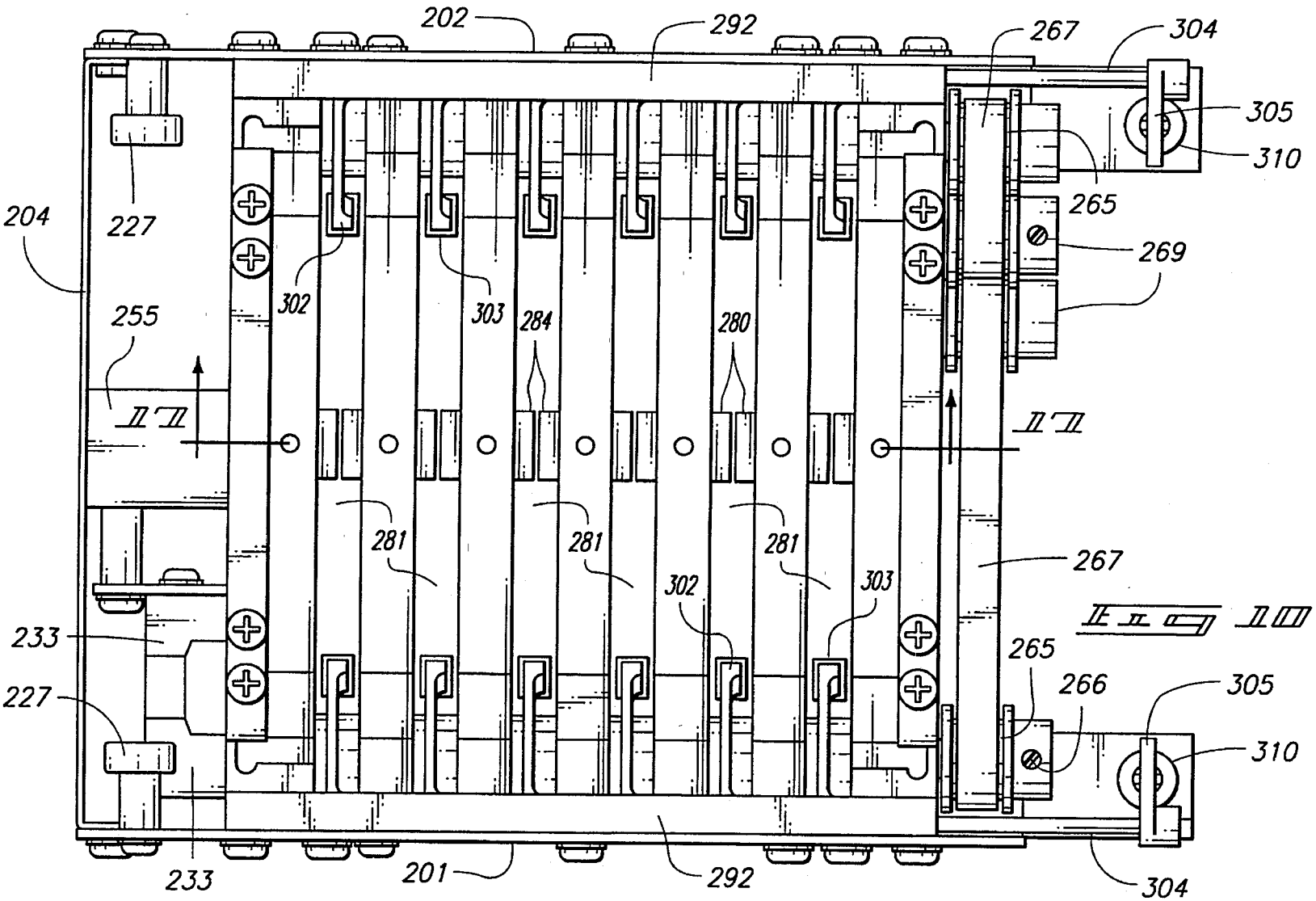
FIG. 10 is an enlarged partial top view of the shuffler of FIG. 7 taken along a line of sight indicated by view line 10—10 in FIG. 7.
Figure 11:
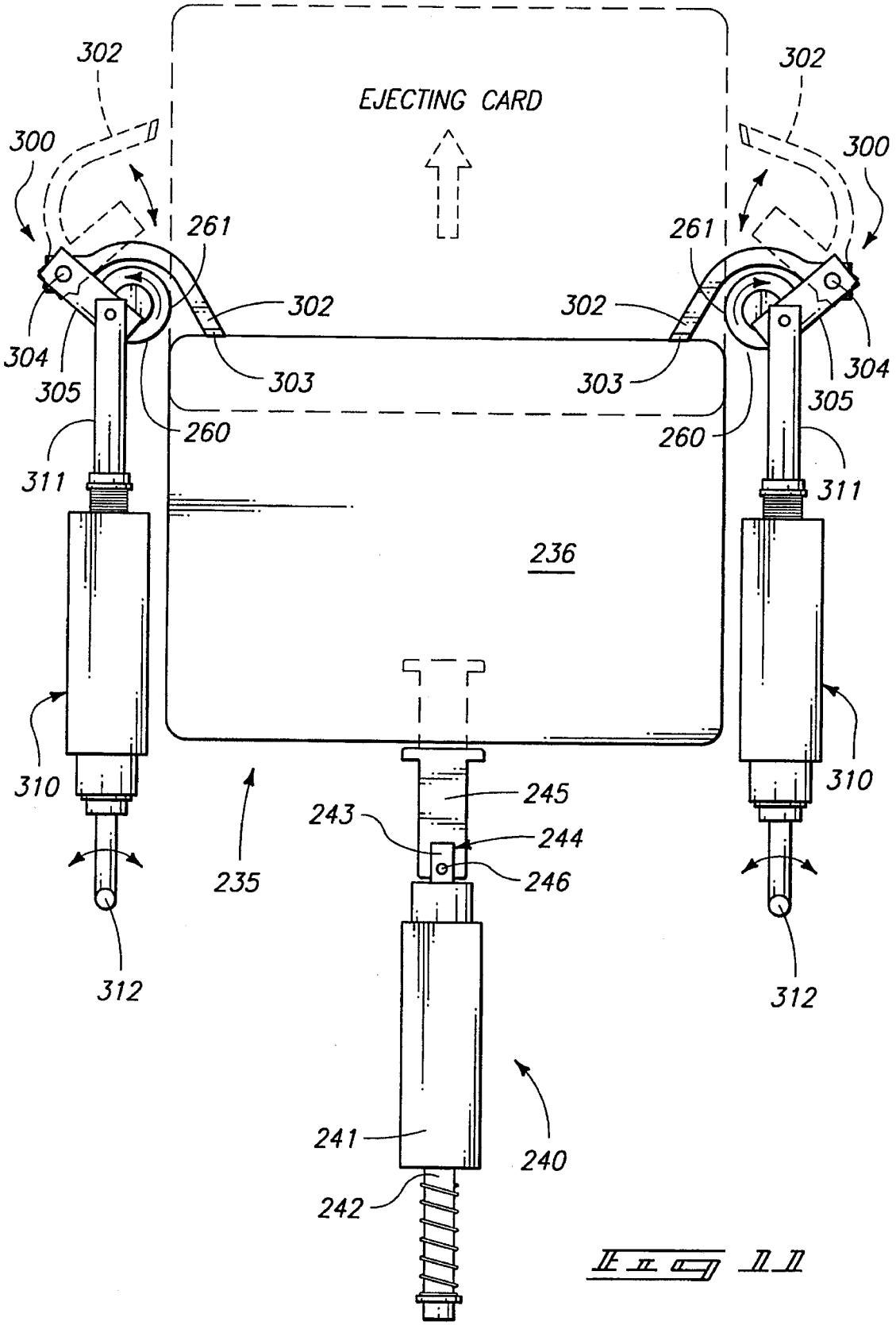
Figure 12:
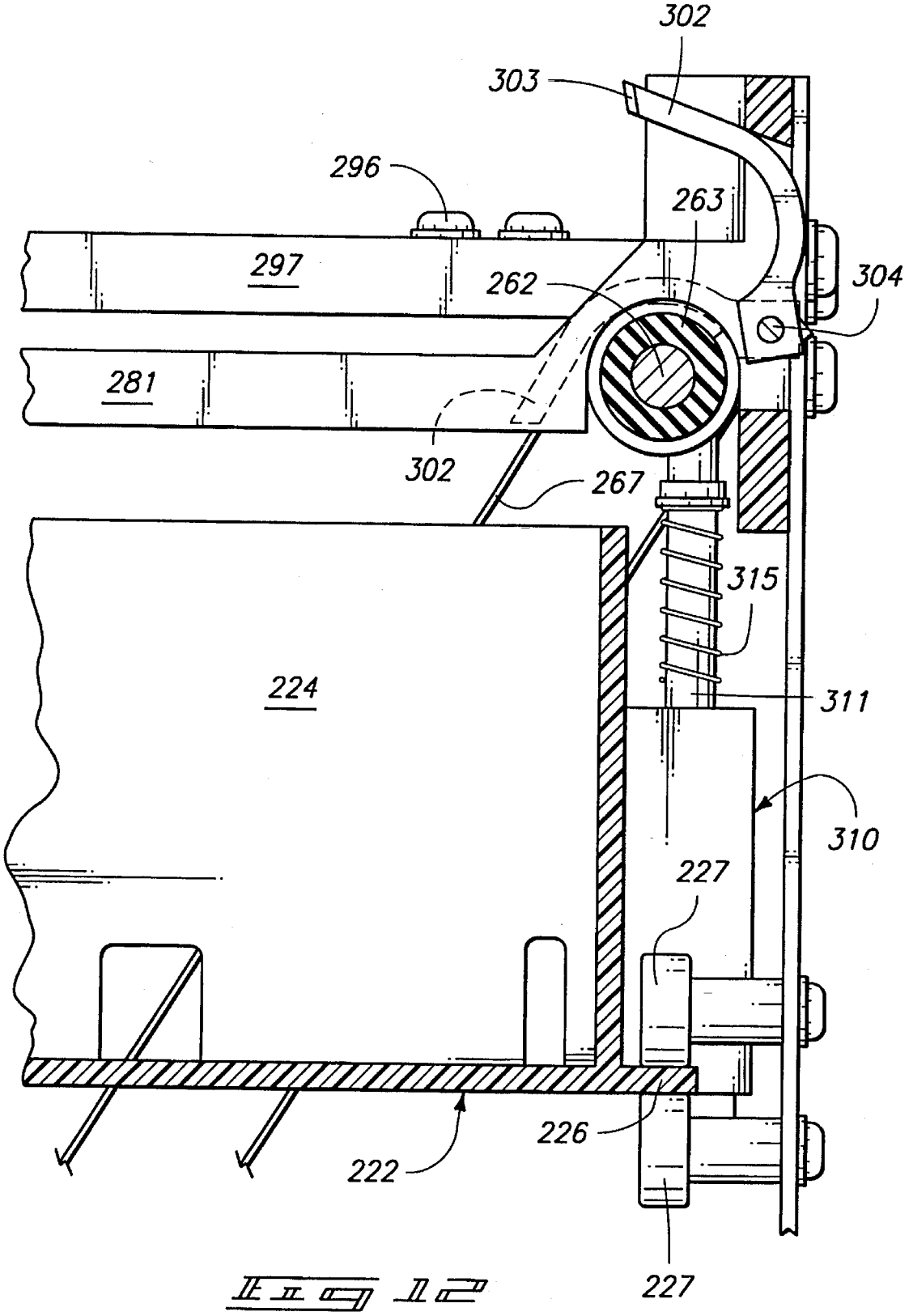
FIG. 12 is an enlarged sectional view taken along section line 12—12 of FIG. 8.
Figure 13:
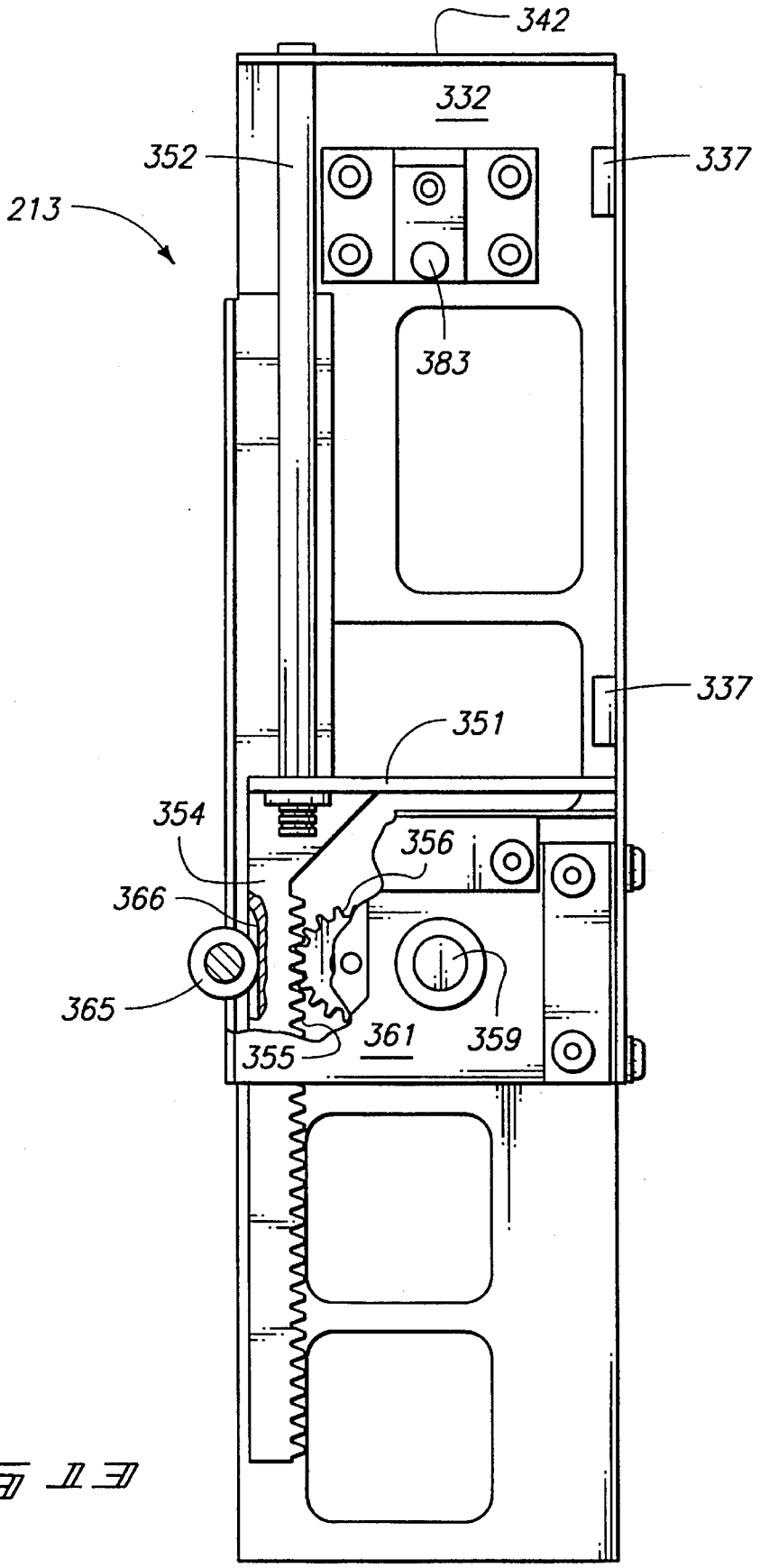
FIG. 13 is an enlarged partial side elevational view showing an outfeed stack elevator assembly forming a part of the shuffler of FIG. 7.

FIG. 12 shows the preferred construction of discharge rollers 260 in greater detail. Rollers 260 preferably include a discharge roller shaft 262. The rollers also include discharge roller tires 263 which are mounted upon shafts 262. FIG. 10 shows discharge roller driven pulleys 265 which are secured to shafts 263 using set screws 266. FIG. 9 shows a pair of discharge roller drive belts 267 which are trained about driven pulleys 265. Drive belts 267 are also trained about discharge roller primary pulleys 269. FIG. 9 shows a discharge roller drive motor 270. A discharge roller drive gear set (not shown) is used to provide counter-rotationary relationship between primary pulleys 269 so that the discharge rollers 260 are driven in counter-rotationary relationship, preferably at the same angular velocity.

Double Card Discharge Resistors

Figure 17:
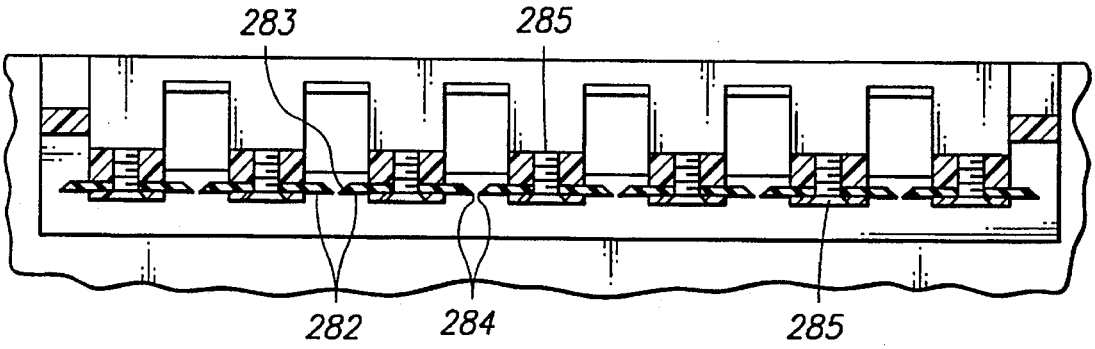
FIG. 17 is a partial sectional view taken along section line 17—17 of FIG. 9.
Figure 18:
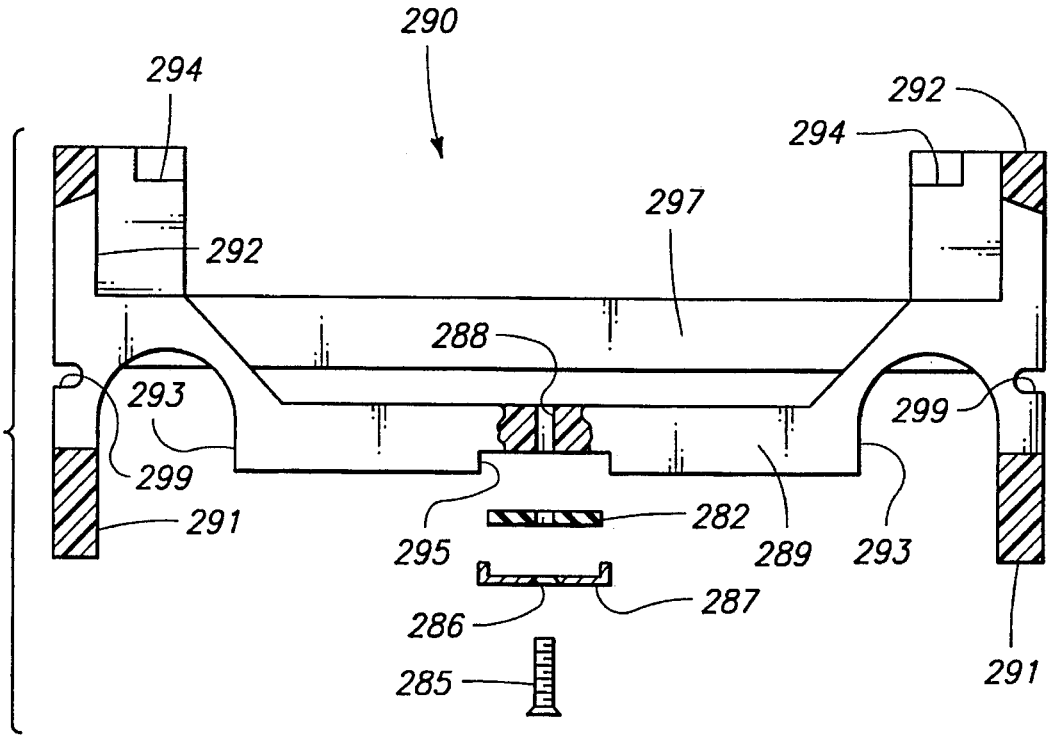
FIG. 18 is a detail sectional view showing a discharge opening and de-doubler mounting piece with portions thereof in exploded presentation.
Figure 11:
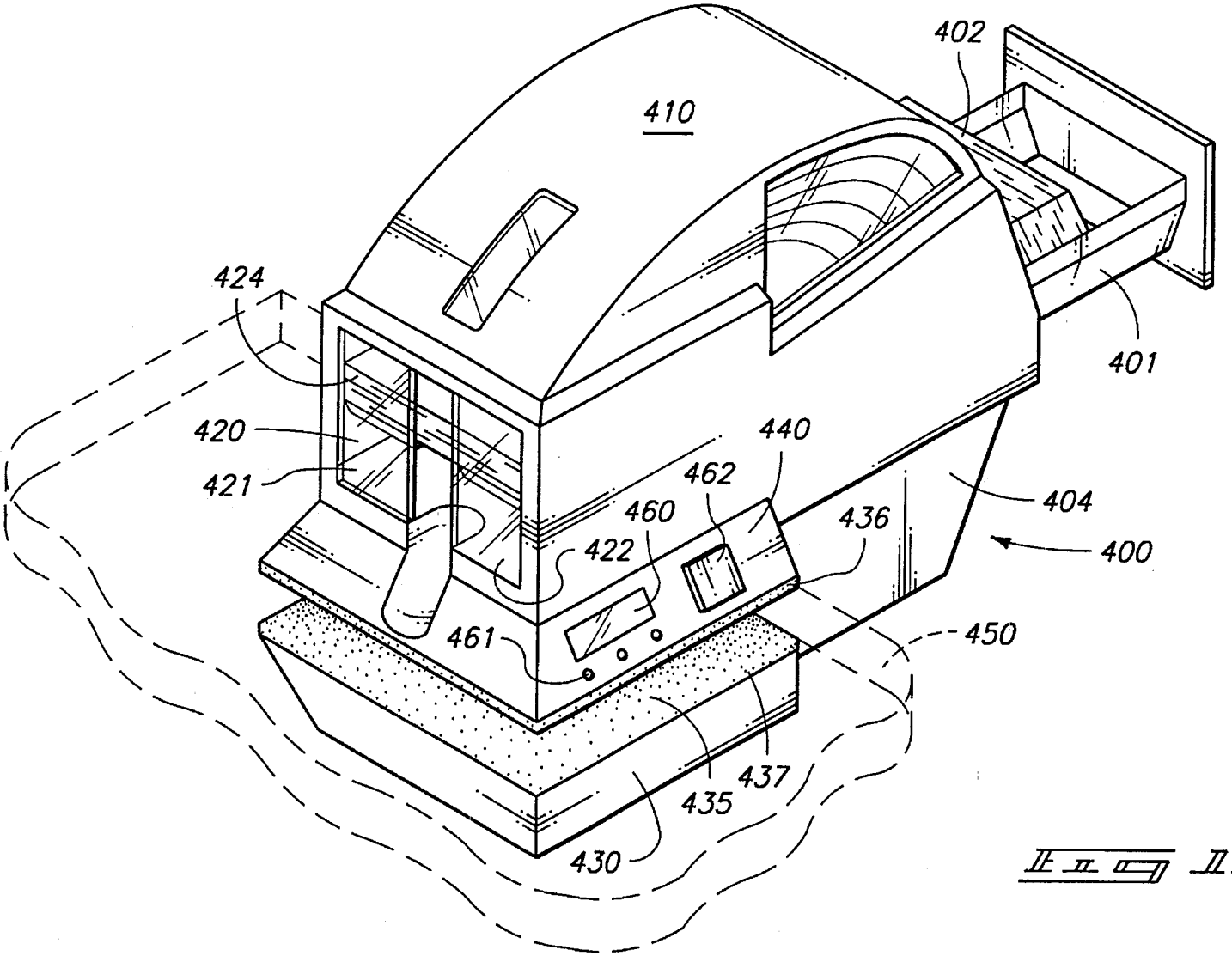

The first subdivision 211 also preferably includes resistors for resisting discharge of cards to prevent or greatly reduce ejection of more than one playing card at a time. FIG. 10 shows a preferred discharge resistor in the form of de-doublers 280. De-doublers 280 extend into a discharge opening 281. Discharge openings 281 are provided for each of the ejectors 240. De-doublers 280 preferably include flexible de-doubler arms 282 which are best seen in FIGS. 17 and 18. De-doubler arms 282 preferably have a pointed tip 283. The de-doubler arms are arranged in opposing pairs with pointed tips 283 adjacent across a card discharge gap 284 which extends between tips 283 at the complementary de-doubler arms. Fasteners 285 extend through an aperture 286 formed in a de-doubler support piece 287. Fasteners 285 also extend through an aperture formed in de-doubler arm 282. Fastener 285 is received within a mounting aperture 288 formed in the associated de-doubler support member or beam 289.

Cards are initially ejected by ejectors 240 upwardly, and are engaged by discharge rollers 260. De-doublers 280 preferably resist discharge of cards which, due to card surface friction, may be ejected along with the card which is positioned directly in-line with an ejection head 245. De-doublers 280 preferably engage the discharging cards immediately before they are contacted by discharge rollers 260.

FIG. 18 shows the preferred construction for de-doubler support beams 289. Beams 289 advantageously form a part of an integrated discharge opening and de-doubler mounting piece 290. Mounting piece 290 includes top side rails 292 which extend along the top outer perimeter of the mounting piece. Mounting piece 290 also includes bottom side rails 291 which extend along the bottom outer perimeter of the mounting piece. Beams 289 further preferably include discharge roller cutouts 293. Beams 289 are further provided with a de-doubler mounting notch 295, which receives de-doubler arm piece 282 and de-doubler mounting piece 287.

Mounting piece 290 also includes a front mounting bar 297 and a rear mounting bar 298. Piece 290 is mounted using suitable fasteners 296 which extend through bars 297 and 298 to connect with the frame 201. Mounting piece 290 further has guide rest receptacles 294 formed to receive the card guide 218 therein. Mounting piece 290 still further has side cutouts 299 which mount a pivot shaft 304 which will be explained below in connection with the infeed stack alignment mechanism 300.

Infeed Stack Straightening or Aligning Mechanism

First subdivision 211 also preferably includes an infeed stack straightening or aligning apparatus 300. Infeed stack straightener 300 includes a series of straightening arms 302. Straightener arms 302 are advantageously provided with cushioned shoes 303. FIG. 11 shows fundamental components of the infeed stack straightener 300. Straightener arms 302 are mounted on a straightener shaft 304 to provide a gang of arms which all similarly positioned with regard to their angle relative to the infeed stack array. Arms 302 pivot with shaft 304 to provide synchronous tamping action upon the upper edges of the cards 236.

Shaft 304 is operated by an actuator which as shown includes a connected straightener crank arm 305 attached to shaft 304. Crank arm 305 is pivotally connected to a straightener actuator or operator solenoid 310. Operator 310 includes an output shaft 311, which is pivotally connected to a distal portion of crank arm 305. Operator 310 is at the lower end pivotally connected to frame 201 using a mounting pin 312. Operators 310 are preferably electrically-actuated solenoids which controllably reciprocate output shafts 311. The reciprocal action of shafts 3 11 cause the straightener arms 302 to move from the retracted position shown in phantom in FIG. 11 downwardly and inwardly into the extended straightening position shown with solid lines in FIG. 11. When in the extended position, the stack straightener brings contact shoes 303 into engagement against the upper edge surface of cards 236. This provides a tamping downward force which returns individual cards which may have been displaced upwardly along with the previously ejected card. The tamping or similar alignment or straightening operation used to straighten the cards back into alignment within the infeed array can be performed after every ejection or with some other frequency found desirable.

Operator 310 also preferably includes a return spring 315 shown in FIG. 12. Return spring 315 causes the straightening arms 302 to retract upwardly. The construction of side rails 292 includes a downwardly oriented alignment arm stop surface 277 which is preferably angled to form a mechanical stop against which the arms 302 can strike when returned by return spring 315.

Card Guide

The second major subdivision 212 is principally composed of a discharging card guide 218. Card guide 218 includes a plurality of guide vanes 301–307 which provide suitable trajectories for cards being discharged therethrough. Guide vanes 301–307 define discharging card guide channels 321–326. The guide channels are preferably defined in a curvilinear geometry. The curvilinear vanes are preferably shaped and spaced such that discharging cards do not contact against both adjacent vanes at any particular instance in the card's trajectory.

The discharge edges of vanes 301–306 are adjacent to a guide-receiver chamber 330. Upper vane 307 forms a substantially continuous cover which extends past the discharge edges of the other vanes and over the upper frontal portions of the guide 218. This defines the frontal boundary of chamber 330. Cards emit from channels 321–326, and are further guided by upper vane 307. Vane 307 guides the discharging cards into the card receiver 219.

Shuffled Card Receiver

Figure 14:
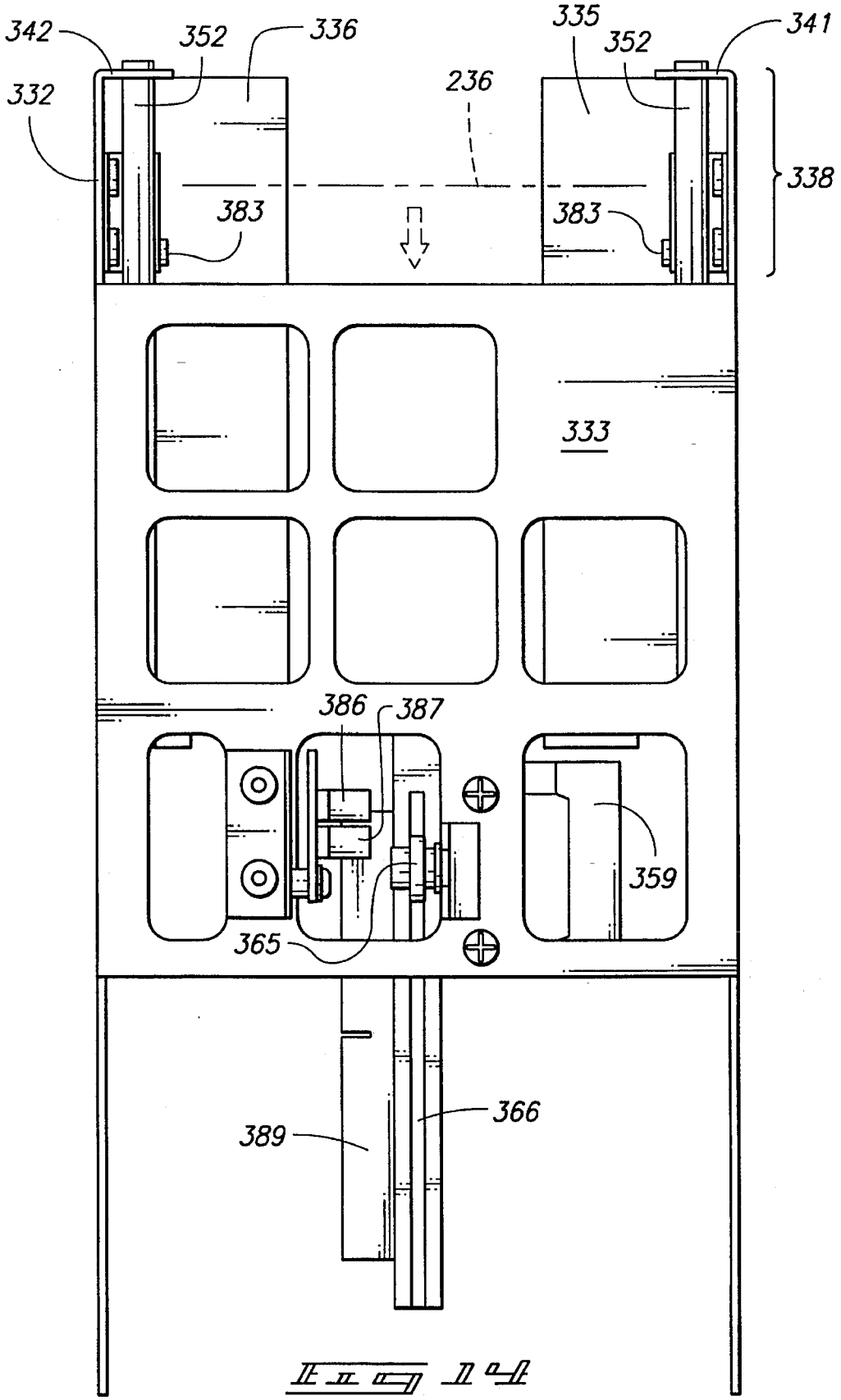
FIG. 14 is a rear view of the elevator assembly shown in FIG. 13.
Figure 11:
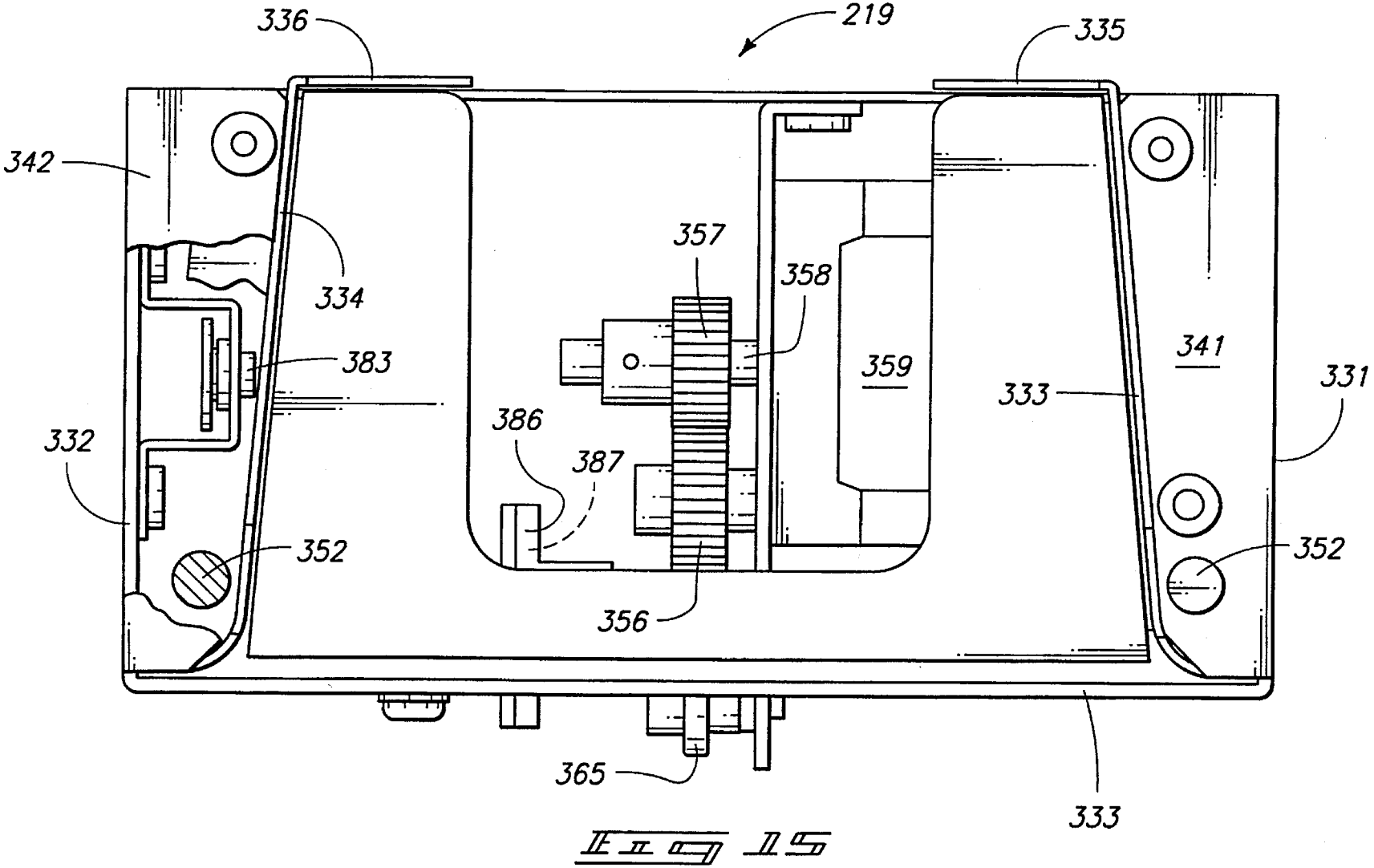
Figure 11:
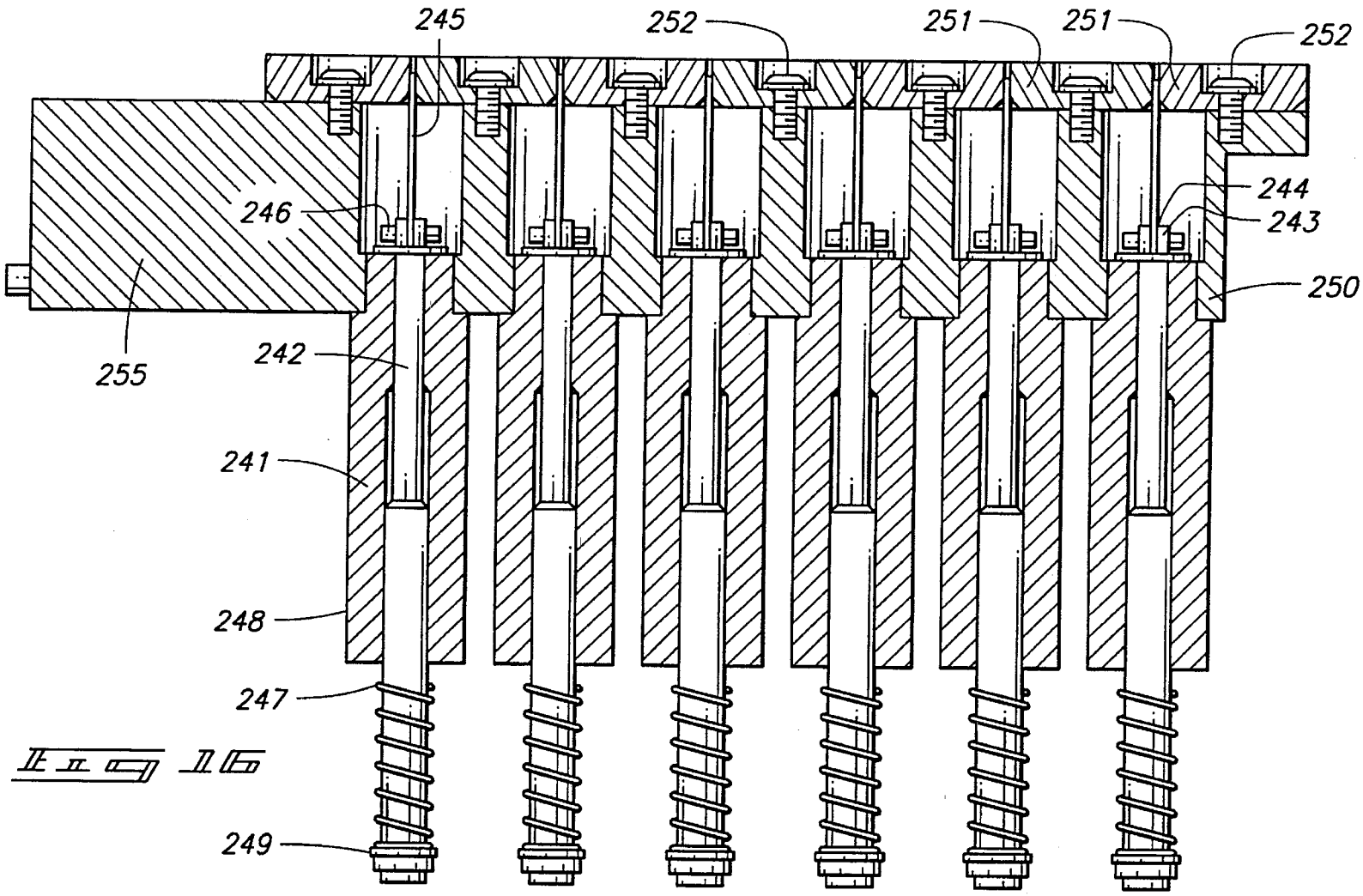

The third main subdivision of shuffler 200 includes the shuffled card receiver 219. Shuffled card receiver 219 forms a second card holder which holds a shuffled card stack array 350. The shuffled card receiver is in part defined by a third subdivision portion of frame 201. More specifically, the third subdivision includes two frame side panels 331 and 332. A rearward frame panel 333 extends between and is connected to panels 331 and 332. FIG. 15 shows that the frame further includes two top panel portions 341 and 342. FIG. 15 further shows opposing card receiver guide pieces 333 and 334. Guide pieces 333 and 334 include frontal panels 335 and 336, which extend along portions of the front of the card receiver. Frontal panels 335 and 336 can be mounted upon receiver hinges 337 to allow the panels to be pivoted for removal of the shuffled stack of cards. Cards 236 are received within an upper reception zone 338 (FIG. 14) above panel 333. Cards 236 strike against front panels 335 and 336 due to the momentum of the cards as they are emitted from the guide section 218. Cards 236 then drift downwardly within receiver 219 to form an outfeed stack 350 which rests upon a receiver floor panel or platform 351.

Card receiver or collector 219 preferably is constructed to enable floor panel 351 to be controllably movable. Floor panel 351 is moved downwardly as the number of cards in stack 350 increases. This allows the drop distance from chamber 330 to receiver floor 351, or the uppermost card in stack 350, to be maintained within a distance which reduces the risk that the cards will turn over, such as into a face-up condition.

Receiver floor panel 351 is preferably connected to and forms a part of a receiver elevator 220 which serves to move the floor panel. Receiver elevator 220 includes a pair of elevator guide rods 352. Elevator guide rods 352 are mounted to the frame of third subdivision 213. Elevator 220 also preferably includes an elevator drive bar 354, which has an associated gear rack 355. Gear rack 355 is engaged by an elevator drive pinion 356. Drive pinion 356 is driven by an elevator motor output gear 357. Gear 357 is mounted upon an output shaft 358, forming a part of elevator drive motor 359. The elevator drive motor is supported upon a movable elevator motor mount subassembly 361.

The elevator carriage is also guided by a rear elevator tracking or guide wheel 365. Wheel 365 is mounted for rotation relative to panel 333. Wheel 365 is received in an elevator tracking groove 366 formed in the back face of drive bar 354. As the elevator platform moves up and down the wheel rotates and guides the unit along with guide bars 352.

Although the receiver elevator is described with a rack and pinion gear drive, it should be understood that alternative drive configurations are possible, such as a cable drive (not shown).

Control System—Second Embodiment

Figure 20:
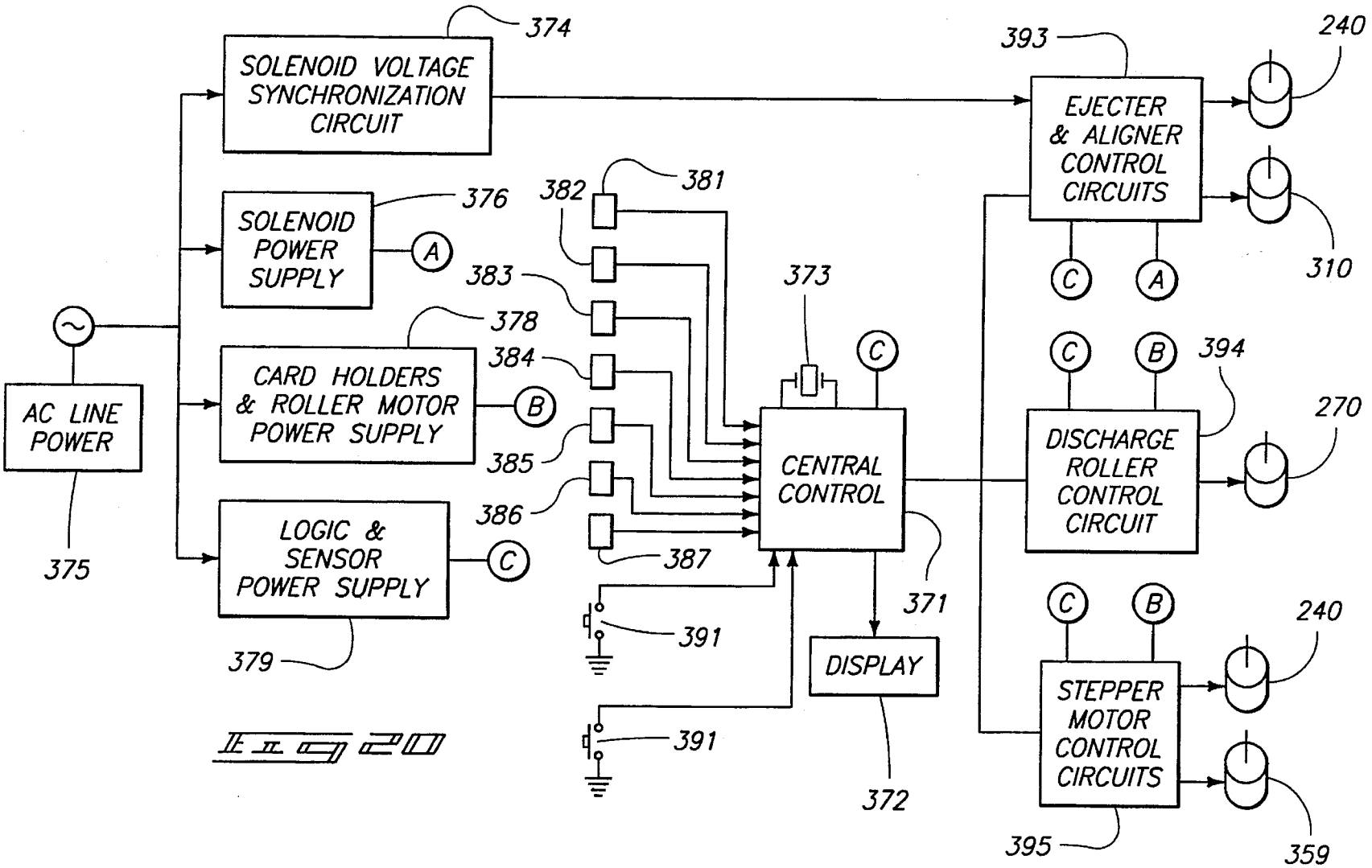
FIG. 20 is a control system schematic diagram of a control system preferred for the embodiment of FIG. 7.

FIG. 20 shows a preferred control system 370 used in shuffler 200. Control system 370 includes a central controller 371 which is preferably a programmable microprocessor controller of suitable type and computational capacity. A Central controller 371 is advantageously connected to an optional visual display unit 372 which can be used to indicate the operational status and other information to the human operator. A suitable timing crystal 373 is connected to controller 371 to provide the basis for a clock-counter forming a part of the controller.

Control system 370 also includes several power supply related circuits which provide needed voltages for remaining system components. As shown, there is a solenoid line voltage synchronization circuit 374 which functions to synchronize solenoid operation with the phase of power being supplied via the AC power line 375. A solenoid power supply 376 provides a suitable solenoid operating voltage, such as the preferred 170 volt alternating current used for solenoids 240 and 310. Power is also provided by a card holder and roller motor power supply 378 which provides suitable current for the motors 270, 233 and 359, such as the preferred 28 volts direct current. Various sensor and logic circuitry are provided with power from a logic and sensor power supply 379, which provides the preferred 5 volt direct current.

Control system 370 also includes a number of sensors 381–387 which monitor operation of shuffler 200. The first sensor is an infeed tray optical beam sensor 381 which detects when the cassette 222 has a limited number of remaining cards. These remaining cards form a last card set containing approximately five to thirty (5–30) cards. This is used to change the operational mode of the shuffler to sequentially eject the last card set without randomly picking new discharge positions. This improves the ejection rate when a small number of cards are left. The value or specific nature of the last set of cards is unpredictable due to removal of cards from intervening positions during earlier card discharges.

The next sensor is an optical beam zero card sensor 382 used to detect when all cards have been discharged from the infeed holder.

The next sensor is an optical beam receiver top card sensor 383. Sensor 383 detects the upper card or cards stacked in receiver 219 and is used to control the elevator position.

An infeed cassette home position sensor 384 is used to detect the home or forward position of the cassette as moved by the discharge position movement. The position of the infeed cassette is also monitored by an infeed discharge position sensor 385. Sensor 385 monitors the position of the cassette and communicates the position information to the central controller.

The outfeed or receiver elevator position is also sensed using a receiver elevator home position sensor 386. The elevator position is otherwise sensed by a receiver elevator position sensor 387. A sensor track 389 (FIG. 14) moves through sensors 386 and 387.

FIG. 20 also shows a start switch 391, and a stop switch 392, which are manually activated switches on a control panel (not shown) of shuffler 200.

FIG. 20 further shows an ejector and aligner control circuit 393 which receives control signals from controller 301, and power from units 374, 376, and 379. Circuit 393 is connected to solenoids 240 and 310 to provide operation of the ejectors and aligning mechanisms.

A discharge roller motor control circuit 394 is connected to controller 370 and to roller motor 270. This provides operation of roller 260 when performing the discharging functions.

FIG. 20 further shows stepper motor control circuits 395 which are controlled by central controller 371 and connected to the stepper or other suitable motors 233 and 359 used to position the infeed array and outfeed elevator.

Operation and Methods—Second Embodiment

The methods and operation explained hereinabove in connection with the first embodiment is also in general applicable to the operation of shuffler 200. That description will not be repeated here. Special mention will be made below with regard to additional operational aspects of shuffler 200.

The forming of an infeed or first stack array as preferred for shuffler 200 is done with the cards oriented in an inclined angular position as indicated hereinabove. This inclined orientation also applies in the discharging and associated ejecting steps.

Shuffler 200 is also capable of moving the infeed array during operation to perform a jostling or shaking operation which helps to keep the cards in upright but preferably inclined orientation on edge within the infeed cassette. The jostling function can be performed using the cassette drive powering the cassette in either, or preferably both directions, and then to a desired discharge position. The jostling is advantageously performed a number of times throughout the discharge operations used in connection with the shuffling of approximately six decks of fifty-two cards each. A weight or other backstop member, such as follower 228, can be used to supplement normal forces between the cards of the infeed stack array and keep the stack upright. The angled orientation of the infeed and a weighting or other biasing action by the follower tends to move the cards forwardly against the front panel 224 and maintain upstanding card positions within the infeed stack.

Shuffler 200 also additionally functions by positioning the infeed card holder and supported infeed stack array into various discharge card positions. These various discharge card positions are achieved by moving relative to the ejectors 240 and the frame 201.

Shuffler 200 further preferably operates by discharging a number of different cards for each discharge position of the infeed cassette. This speed operation and reduces mechanical function. The number of cards ejected at any particular cassette position may vary from one to six, depending upon the random number algorithm used and the number of cards left in the infeed array. As the stack diminishes, the number of ejectors which can be used decreases and the number of infeed holder positioning moves will typically increase. At then end of the stack, the sensor 381 detects the last cards and operation changes to a sequential ejection of the remaining cards.

Shuffler 200 also performs a de-doubling function using the de-doublers 280. This de-doubling operation is a resisting operation which prevents discharge of more than one card in most instances. The de-doubling functions by flexibly restricting the discharge opening 281 to applying frictional resistance against the second card being forced upwardly by friction with the card being ejected. The de-doubling is preferably performed before the extracting force is applied by rollers 260.

Shuffler 200 still further performs a localized aligning operation against the cards held in the infeed holder. This aligning or straightening is effected by the alignment arms 302 and associated foot pieces 303 which are brought into contact with the cards adjacent to the ejectors. As the infeed holder moves, the entire stack is straightened and aligned. The aligning is best performed by pivoting a gang or series of said arms in synchronized operation against the stack. After the aligning step is performing the arms are removed by retracting them upwardly and outwardly to reopen the discharge openings.

Shuffler 200 also has a guide section 218 which performs a channeling and guiding function for discharged cards. The guiding is preferably performed by guide vanes against which the discharging cards pass between. The guiding function further preferably includes directing the discharging cards into the receiver 219.

The receiving and associated forming of the outfeed or shuffled stack 350 is advantageous in shuffler 200 in that the shuffled stack holder is preferably constructed to allow moving the receiver, such as by moving support floor pane 351. This moving or positioning is accomplished in the preferred embodiment by controllably positioning the receiver elevator 220. The controlling is aided by sensing the shuffled stack height. This performs a function of controlling the drop distance cards fall within receiver 219.

Third Embodiment

FIG. 19 shows a further preferred shuffler 400 made in accordance with this invention. Shuffler 400 includes an infeed cassette 401 which holds an infeed stack or array 402 therein. An injector and discharge mechanism similar to that described above in connection with the second embodiment is included within the outer shuffler case 404. A shuffler discharge guide section 410 extends across the upper portions of the shuffler. A shuffled stack or array receiver 420 is included near the front of the machine. The construction of receiver 420 is similar to that described hereinabove. Receiver 420 is provided with two opening doors 421 and 422 which pivot to allow the shuffled stack or array 424 to be withdrawn from the front of the machine.

Shuffler 400 is advantageous in outer construction by having a lower mounting arm 430 which extends in spaced relationship from an upper mounting section 440 to allow a card table surface 450, shown in phantom, extend within a mounting receptacle 435. Mounting receptacle 435 is preferably provided with contact surfaces or pads 436 and 437 which extend along and contact the upper and lower surfaces of table 450. Lower mounting section 430 can advantageously include adjustment fasteners (not shown) which allow force to be developed against lower pad 437 to clamp the shuffler unit upon card table surface 450.

Shuffler 400 also advantageously includes a visual display 460 and indicator lamps 461. A start and stop button 462 is also provided.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. An automated playing card shuffler, comprising:

an infeed array holder for holding an infeed array of unshuffled playing cards;

a shuffled array receiver for holding a shuffled array containing shuffled playing cards;

a plurality of ejectors mounted adjacent the infeed array holder for ejecting playing cards from the infeed array holder at various card discharge positions, the playing cards ejected by the plurality of ejectors being received in the shuffled array receiver.

2. A playing card shuffler according to claim 1 wherein said plurality of ejectors are mounted upon at least one ejector carriage which is movable relative to a frame.

3. A playing card shuffler according to claim 1 wherein said infeed array holder is movable relative to a frame.

4. A playing card shuffler according to claim 1 wherein said plurality of ejectors and said unshuffled array holder are mounted so as to provide relative linear motion therebetween.

5. A playing card shuffler according to claim 1 and further comprising at least one extractor which engages playing cards which are displaced by said plurality of ejectors.

6. A playing card shuffler according to claim 1 and further comprising at least one removal resistor which provides counteractive force opposing displacement of playing cards.

7. A playing card shuffler according to claim 1 and further comprising at least one controllably activated removal resistor which provides controlled intermittent counteractive force opposing displacement of playing cards.

8. A playing card shuffler according to claim 1 and further comprising at least one extractor which assists in discharging cards which have been displaced by said plurality of ejectors; said at least one extractor including at least a pair of rollers which engage edges of discharging cards.

9. A playing card shuffler according to claim 1 and further comprising at least one removal resistor which provides counteractive force opposing displacement of playing cards; said at least one removal resistor including resilient members which engage cards displaced from the unshuffled stack.

10. A playing card shuffler according to claim 1 and further comprising at least one removal resistor which provides counteractive force opposing displacement of playing cards; said at least one removal resistor including resilient members which are mounted for movement.

11. A playing card shuffler according to claim 1 and further comprising at least one removal resistor which provides counteractive force opposing displacement of playing cards; said at least one removal resistor including resilient members which rotate.

12. A playing card shuffler according to claim 1 and further comprising at least one straightener for straightening cards in the infeed stack.

13. A playing card shuffler according to claim 1 and further comprising at least one discharge guide for guiding cards discharged from the infeed stack as the cards move toward the shuffled array receiver.

14. A playing card shuffler according to claim 1 and further comprising at least one discharge guide for guiding cards discharged from the infeed stack as the cards move toward the shuffled array receiver; said at least one discharge guide including at least one rotatable guide.

15. A playing card shuffler according to claim 1 and further comprising at least one discharge guide for guiding cards discharged from the infeed stack as the cards move toward the shuffled array receiver; said at least one discharge guide including a plurality of guide channels.

16. A playing card shuffler according to claim 1 and further comprising at least one infeed stack card detector for sensing the approximate number of cards contained in the infeed stack holder.

17. A playing card shuffler according to claim 1 and further comprising a receiver panel drive for moving a panel of the shuffled array receiver to accommodate additional cards being discharged into the shuffled array receiver.

18. A playing card shuffler according to claim 1 and further comprising at least one position indicator for indicating the relative position between the unshuffled array holder and the plurality of ejectors.

19. A playing card shuffler according to claim 1 and further comprising at least one controller for controlling operation of the plurality of ejectors.

20. A playing card shuffler according to claim 1 and further comprising at least one controller for controlling operation of the plurality of ejectors; said controller including a random number generator for generating randomly ordered numbers used in selecting which cards will be ejected from the infeed array holder.

21. A playing card shuffler according to claim 1 and further comprising:

at least one controller for controlling operation of the plurality of ejectors;

at least one position indicator for indicating the relative position between the unshuffled stack holder and the at least one ejector carriage.

22. An automated playing card shuffler, comprising:

an infeed stack holder for holding an infeed stack of unshuffled playing cards arranged with adjacent cards in contacting relationship;

a shuffled stack receiver for holding a shuffled array containing shuffled playing cards;

at least one ejector mounted adjacent the infeed stack holder for ejecting playing cards from the infeed stack holder at various positions from the infeed stack, the playing cards ejected by the at least one ejector being received in the shuffled stack receiver;

an ejection movement for providing relative movement between the at least one ejector and said infeed stack holder to thereby allow said at least one ejector to eject cards from various card discharge positions of the infeed stack.

23. A playing card shuffler according to claim 22 wherein there are a plurality of ejectors; said ejectors being mounted upon said ejection movement which includes at least one ejector carriage which is movable relative to a frame.

24. A playing card shuffler according to claim 22 wherein said infeed stack holder is movable relative to a frame.

25. A playing card shuffler according to claim 22 wherein said at least one ejector and said unshuffled stack holder are mounted so as to provide relative linear motion therebetween.

26. A playing card shuffler according to claim 22 and further comprising at least one extractor which engages playing cards which are displaced by said at least one ejector.

27. A playing card shuffler according to claim 22 and further comprising at least one removal resistor which provides counteractive force opposing displacement of playing cards.

28. A playing card shuffler according to claim 22 and further comprising at least one controllably activated removal resistor which provides controlled intermittent counteractive force opposing displacement of playing cards.

29. A playing card shuffler according to claim 22 and further comprising at least one extractor which assists in discharging cards which have been displaced by said at least one ejector; said at least one extractor including at least a pair of rollers which engage edges of discharging cards.

30. A playing card shuffler according to claim 22 and further comprising at least one removal resistor which provides counteractive force opposing displacement of playing cards; said at least one removal resistor including resilient members which engage cards displaced from the unshuffled stack.

31. A playing card shuffler according to claim 22 and further comprising at least one removal resistor which provides counteractive force opposing displacement of playing cards; said at least one removal resistor including resilient members which are mounted for movement.

32. A playing card shuffler according to claim 22 and further comprising at least one removal resistor which provides counteractive force opposing displacement of playing cards; said at least one removal resistor including resilient members which rotate.

33. A playing card shuffler according to claim 22 and further comprising at least one straightener for straightening cards in the infeed stack.

34. A playing card shuffler according to claim 22 and further comprising at least one discharge guide for guiding cards discharged from the infeed stack as the cards move toward the shuffled stack receiver.

35. A playing card shuffler according to claim 22 and further comprising at least one discharge guide for guiding cards discharged from the infeed stack as the cards move toward the shuffled stack receiver; said at least one discharge guide including at least one rotatable guide.

36. A playing card shuffler according to claim 22 and further comprising at least one discharge guide for guiding cards discharged from the infeed stack as the cards move toward the shuffled stack receiver; said at least one discharge guide including a plurality of guide channels.

37. A playing card shuffler according to claim 22 and further comprising at least one infeed stack card detector for sensing the approximate number of cards contained in the infeed stack holder.

38. A playing card shuffler according to claim 22 and further comprising a receiver panel drive for moving a panel of the shuffled stack receiver to accommodate additional cards being discharged into the shuffled stack receiver.

39. A playing card shuffler according to claim 22 and further comprising at least one position indicator for indicating the relative position between the unshuffled stack holder and the plurality of ejectors.

40. A playing card shuffler according to claim 22 and further comprising at least one controller for controlling operation of the plurality of ejectors.

41. A playing card shuffler according to claim 22 and further comprising at least one controller for controlling operation of the plurality of ejectors; said controller including a random number generator for generating randomly ordered numbers used in selecting which cards will be ejected from the infeed array holder.

42. A playing card shuffler according to claim 22 and further comprising:

at least one controller for controlling operation of the plurality of ejectors;

at least one position indicator for indicating the relative position between the unshuffled stack holder and the at least one ejector carriage.

43. A method for automated shuffling of playing cards, comprising:

forming an unshuffled stack of playing cards which are to be shuffled: said playing cards being in stacked array formation with contact between adjacent cards of the unshuffled stack;

holding the unshuffled stack in an unshuffled stack holder;

selectively discharging playing cards from the unshuffled stack at various card discharge positions of the unshuffled stack;

receiving playing cards discharged in said discharging step into a shuffled card receiver wherein the discharged playing cards are formed into a shuffled card array;

wherein said selectively discharging includes extracting playing cards from the unshuffled stack array.

44. A method according to claim 43 wherein said selectively discharging includes partially displacing cards from the unshuffled stack; and said extracting is performed on partially displaced cards.

45. A method according to claim 43 wherein said extracting playing cards from the unshuffled stack includes engaging edges of the playing cards with rollers and rolling the playing cards.

46. A method according to claim 43 and further comprising moving to provide relative motion between said plurality of ejectors and the unshuffled stack holder, to position the plurality of ejectors in various discharge positions along the unshuffled stack.

47. A method for automated shuffling of playing cards, comprising:

forming an unshuffled stack of playing cards which are to be shuffled; said playing cards being in stacked array formation with contact between adjacent cards of the unshuffled stack;

holding the unshuffled stack in an unshuffled stack holder;

selectively discharging playing cards from the unshuffled stack at various card discharge positions of the unshuffled stack;

receiving playing cards discharged in said discharging step into a shuffled card receiver wherein the discharged playing cards are formed into a shuffled card array;

resisting discharge of playing cards by providing counteractive force opposing discharge of playing cards from the unshuffled stack.

48. A method according to claim 47 and wherein said resisting discharge of playing cards is by providing controlled intermittent counteractive force opposing discharge of playing cards from the unshuffled stack.

49. A method according to claim 47 and wherein said resisting discharge of playing cards is by providing passive frictional counteractive force opposing discharge of playing cards from the unshuffled stack.

50. A method for automated shuffling of playing cards, comprising:

forming an unshuffled stack of playing cards which are to be shuffled; said playing cards being in stacked array formation with contact between adjacent cards of the unshuffled stack;

holding the unshuffled stack in an unshuffled stack holder;

selectively discharging playing cards from the unshuffled stack at various card discharge positions of the unshuffled stack;

receiving playing cards discharged in said discharging step into a shuffled card receiver wherein the discharged playing cards are formed into a shuffled card array;

moving to provide relative motion between at least one ejector and the unshuffled stack holder, to position the at least one ejector in various discharge positions along the unshuffled stack.

51. A method according to claim 50 and further comprising dropping the discharged cards into the shuffled array.

52. A method according to claim 50 and wherein said moving provides relative linear motion between at least one ejector and the unshuffled stack holder, to position the at least one ejector in various discharge positions along the unshuffled stack.

53. A method according to claim 50 and further comprising guiding cards discharged from the unshuffled stack array.

54. A method according to claim 50 and further comprising straightening playing cards held in the unshuffled stack array.

55. A method for automated shuffling of playing cards, comprising:

forming an unshuffled stack of playing cards which are to be shuffled; said playing cards being in stacked array formation with contact between adjacent cards of the unshuffled stack;

holding the unshuffled stack in an unshuffled stack holder;

selectively discharging playing cards from the unshuffled stack at various card discharge positions of the unshuffled stack;

receiving playing cards discharged in said discharging step into a shuffled card receiver wherein the discharged playing cards are formed into a shuffled card array;

detecting the approximate number of cards held in the unshuffled stack.

56. A method for automated shuffling of playing cards, comprising:

forming an unshuffled stack of playing cards which are to be shuffled; said playing cards being in stacked array formation with contact between adjacent cards of the unshuffled stack;

holding the unshuffled stack in an unshuffled stack holder;

selectively discharging playing cards from the unshuffled stack at various card discharge positions of the unshuffled stack;

receiving playing cards discharged in said discharging step into a shuffled card receiver wherein the discharged playing cards are formed into a shuffled card array;

wherein said selectively discharging step is effected using a plurality of ejectors.

57. A method for automated shuffling of playing cards, comprising:

forming an unshuffled stack of playing cards which are to be shuffled; said playing cards being in stacked array formation with contact between adjacent cards of the unshuffled stack;

holding the unshuffled stack in an unshuffled stack holder;

selectively discharging playing cards from the unshuffled stack at various card discharge positions of the unshuffled stack;

receiving playing cards discharged in said discharging step into a shuffled card receiver wherein the discharged playing cards are formed into a shuffled card array;

resisting discharge of playing cards by engaging the cards with at least one resilient member.

58. A method for automated shuffling of playing cards, comprising:

forming an unshuffled stack of playing cards which are to be shuffled; said playing cards being in stacked array formation with contact between adjacent cards of the unshuffled stack;

holding the unshuffled stack in an unshuffled stack holder;

selectively discharging playing cards from the unshuffled stack at various card discharge positions of the unshuffled stack;

receiving playing cards discharged in said discharging step into a shuffled card receiver wherein the discharged playing cards are formed into a shuffled card array;

resisting discharge of playing cards by engaging the cards with at least one rotating member.

59. A method for automated shuffling of playing cards, comprising:

forming an unshuffled stack of playing cards which are to be shuffled; said playing cards being in stacked array formation with contact between adjacent cards of the unshuffled stack;

holding the unshuffled stack in an unshuffled stack holder;

selectively discharging playing cards from the unshuffled stack at various card discharge positions of the unshuffled stack;

receiving playing cards discharged in said discharging step into a shuffled card receiver wherein the discharged playing cards are formed into a shuffled card array;

moving a supporting panel of the shuffled card receiver to better accommodate playing cards being received therein.

60. A method for automated shuffling of playing cards, comprising:

holding an unshuffled array of playing cards in an unshuffled array holder;

selectively discharging playing cards from the unshuffled array holder at various card discharge positions of the unshuffled array; said selectively discharging step being effected using a plurality of ejectors;

moving to provide relative motion between said plurality of ejectors and the unshuffled array holder, to position the plurality of ejectors in various discharge positions along the unshuffled array;

receiving playing cards discharged in said discharging step into a shuffled card receiver wherein the discharged playing cards are formed into a shuffled card array.

61. A method according to claim 60 wherein said selectively discharging includes partially displacing cards from the unshuffled array.

62. A method according to claim 60 wherein said selectively discharging includes:

partially displacing cards from the unshuffled array;

extracting partially displaced cards.

63. A method according to claim 60 wherein said selectively discharging includes extracting playing cards from the unshuffled array.

64. A method according to claim 60 wherein said selectively discharging includes extracting playing cards from the unshuffled array; said extracting including engaging edges of the playing cards with rollers and rolling the playing cards.

65. A method according to claim 60 and further comprising resisting discharge of playing cards by providing counteractive force opposing discharge of playing cards from the unshuffled array.

66. A method according to claim 60 and further comprising resisting discharge of playing cards by providing controlled intermittent counteractive force opposing discharge of playing cards from the unshuffled array.

67. A method according to claim 60 and further comprising resisting discharge of playing cards by providing passive frictional counteractive force opposing discharge of playing cards from the unshuffled array.

68. A method according to claim 60 and further comprising dropping the discharged cards into the shuffled array.

69. A method according to claim 60 wherein said moving provides relative linear motion.

70. A method according to claim 60 and further comprising detecting the approximate number of cards held in the unshuffled array.

71. A method according to claim 60 and further comprising guiding cards discharged from the unshuffled array.

72. A method according to claim 60 and further comprising resisting discharge of playing cards by engaging the cards with at least one resilient member.

73. A method according to claim 60 and further comprising resisting discharge of playing cards by engaging the cards with at least one rotating member.

74. A method according to claim 60 and further comprising straightening playing cards held in the unshuffled array.

75. A method according to claim 60 and further comprising moving a supporting panel of the shuffled card receiver to better accommodate playing cards being received therein.

* * * * *